US008739532B2

(12) United States Patent
Kawajiri et al.

(10) Patent No.: US 8,739,532 B2
(45) Date of Patent: Jun. 3, 2014

(54) EXHAUST HEAT REGENERATION SYSTEM

(75) Inventors: Kazuhiko Kawajiri, Tokyo (JP); Minoru Sato, Tokyo (JP); Kazunori Tsuchino, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 167 days.

(21) Appl. No.: 13/378,841

(22) PCT Filed: Jul. 26, 2010

(86) PCT No.: PCT/JP2010/062506

§ 371 (c)(1),
(2), (4) Date: Dec. 16, 2011

(87) PCT Pub. No.: WO2011/016354

PCT Pub. Date: Feb. 10, 2011

(65) Prior Publication Data

US 2012/0090317 A1 Apr. 19, 2012

(30) Foreign Application Priority Data

Aug. 5, 2009 (JP) ..... 2009-182289

(51) Int. Cl.

| | |
|---|---|
| ***B60K 6/20*** | (2007.10) |
| ***F02G 3/00*** | (2006.01) |
| ***F01K 23/10*** | (2006.01) |
| ***F04B 39/06*** | (2006.01) |
| ***F04B 39/02*** | (2006.01) |
| ***F04B 17/00*** | (2006.01) |
| ***F04B 35/04*** | (2006.01) |

(52) U.S. Cl.
USPC ..... 60/618; 60/597; 60/616; 417/373; 417/410.5

(58) Field of Classification Search
USPC ..... 60/419, 456, 597, 616, 618, 620; 123/41.19; 62/323.1, 402; 417/370, 417/373, 410.5; 418/55.1
See application file for complete search history.

(56) References Cited

U.S. PATENT DOCUMENTS 3,636,706 A * 1/1972 Minto ..... 60/651
5,214,932 A * 6/1993 Abdelmalek ..... 62/238.4

(Continued)

FOREIGN PATENT DOCUMENTS

JP 2005 30386 2/2005
JP 2006-266238 A 10/2006

(Continued)

OTHER PUBLICATIONS

Office Action issued Jun. 5, 2012, in Japanese Patent Application No. 2011-525852 with English translation.

(Continued)

*Primary Examiner* — Thomas Denion
*Assistant Examiner* — Mickey France
(74) *Attorney, Agent, or Firm* — Oblon, Spivak, McClelland, Maier & Neustadt, L.L.P.

(57) ABSTRACT

An exhaust heat regeneration system includes: an evaporator for cooling engine cooling water; an expansion device for expanding the refrigerant heated through the evaporator so as to generate a driving force; a condenser for cooling the refrigerant passing through the expansion device to condense the refrigerant; and a pump for pressure-feeding the refrigerant cooled through the condenser to the evaporator, in which: the expansion device is coupled to the pump by a shaft, and the expansion device and the pump are housed within the same casing to constitute a pump-integrated type expansion device; and the pump includes a high-pressure chamber through which the refrigerant to be discharged to the evaporator flows, the high-pressure chamber being provided on the expansion device side, or a low-pressure chamber through which the refrigerant flowing from the condenser flows, the low-pressure chamber being provided on the expansion device side.

15 Claims, 15 Drawing Sheets

(56) References Cited

U.S. PATENT DOCUMENTS

| | | | | |
|---|---|---|---|---|
| 6,736,609 | B2 * | 5/2004 | Katsukura et al. | 417/365 |
| 6,928,820 | B2 * | 8/2005 | Inaba et al. | 60/618 |
| 7,117,691 | B2 * | 10/2006 | Taniguchi et al. | 62/500 |
| 7,421,853 | B2 * | 9/2008 | Shaffer et al. | 62/500 |
| 8,177,525 | B2 * | 5/2012 | Takahashi et al. | 417/373 |
| 2006/0107681 | A1 * | 5/2006 | Uno et al. | 62/323.1 |
| 2006/0144047 | A1 * | 7/2006 | Inaba et al. | 60/618 |
| 2006/0196204 | A1 * | 9/2006 | Takeuchi et al. | 62/238.6 |
| 2006/0213218 | A1 * | 9/2006 | Uno et al. | 62/467 |
| 2007/0175212 | A1 * | 8/2007 | Uno et al. | 60/519 |
| 2008/0041055 | A1 * | 2/2008 | Miller | 60/659 |

FOREIGN PATENT DOCUMENTS

| | | |
|---|---|---|
| JP | 2007-138797 A | 6/2007 |
| JP | 2007 231855 | 9/2007 |
| JP | 2008 157152 | 7/2008 |

OTHER PUBLICATIONS

International Search Report Issued Oct. 12, 2010 in PCT/JP10/62506 Filed Jul. 26, 2010.

* cited by examiner

EXHAUST HEAT REGENERATION SYSTEM

TECHNICAL FIELD

The present invention relates to an exhaust heat regeneration system for regenerating exhaust heat of cooling water in an engine of an automobile or the like as power by a Rankine cycle.

BACKGROUND ART

A conventional exhaust heat regeneration system is an integral unit including a pump for pressure-feeding a liquid refrigerant in a Rankine cycle, an expansion device for outputting a mechanical energy by expansion of a heated vapor refrigerant, and a loading device for driving the pump as a motor and for generating electric power by using power of the expansion device as a power generator, which are coupled to each other. A high-pressure chamber through which the refrigerant discharged from the pump flows is provided to an outer peripheral portion of the pump. Further, a fin for heat exchange between the refrigerant expanded in the expansion device and the refrigerant in the high-pressure chamber is provided (for example, see Patent Literature 1).

CITATION LIST

Patent Literature

PTL 1: JP 2007-231855 A

SUMMARY OF INVENTION

Technical Problem

However, the related art has the following problems. The conventional exhaust heat regeneration system described in Patent Literature 1 has a configuration in which a passage on an outlet side of the expansion device, corresponding to a working-fluid outlet side of the expansion device, is provided in the vicinity of a part of a passage on an outlet side of the pump, corresponding to a working-fluid outlet side of the pump, to thereby increase the amount of heating for the working fluid on an inflow side of the expansion device so as to increase expansion work in the expansion device. However, heat becomes more likely to be transferred to the pump side to increase a temperature of the pump. As a result, the liquid refrigerant (hereinafter, sometimes referred to simply as "refrigerant") is evaporated and vaporized in the pump (in particular, at the inlet thereof), making it difficult to boost the refrigerant to allow a circulation thereof Therefore, there is a problem in that the Rankine cycle becomes inoperative.

During an operation of the exhaust heat regeneration system, a cooling effect can be obtained by the refrigerant flowing through the pump. If the amount of circulation of the refrigerant is reduced, in particular, when the operation is stopped, however, the cooling effect obtained by the refrigerant cannot be obtained anymore. As a result, the temperature of the pump is increased. Thus, there is another problem in that the Rankine cycle cannot be operated again for several hours or longer until a temperature of the entire pump-integrated type expansion device is lowered.

The present invention has been made to solve the problems described above, and has an object to provide an exhaust heat regeneration system capable of preventing a temperature of a pump of a pump-integrated type expansion device from being increased and capable of performing cooling quickly (for example, within about several minutes) when the temperature of the pump is increased, which can be operated constantly stably even in the case of restart.

Solution to Problem

The present invention provides an exhaust heat regeneration system including: an evaporator for cooling engine cooling water by heat exchange with a refrigerant; an expansion device for expanding the refrigerant heated through the evaporator so as to generate a driving force; a condenser for cooling the refrigerant passing through the expansion device to condense the refrigerant; and a pump for pressure-feeding the refrigerant cooled through the condenser to the evaporator, in which: the expansion device is coupled to the pump by a shaft, and the expansion device and the pump are housed within the same casing to constitute a pump-integrated type expansion device; and the pump includes a high-pressure chamber through which the refrigerant to be discharged to the evaporator flows, the high-pressure chamber being provided on the expansion device side in an axial direction.

Advantageous Effects of Invention

The exhaust heat regeneration system according to the present invention is capable of preventing a temperature of a pump of a pump-integrated type expansion device from being increased and is also capable of performing stable operation.

DESCRIPTION OF EMBODIMENTS

Embodiments 1 to 9 of the present invention are described below.

Embodiment 1

Figure 1:
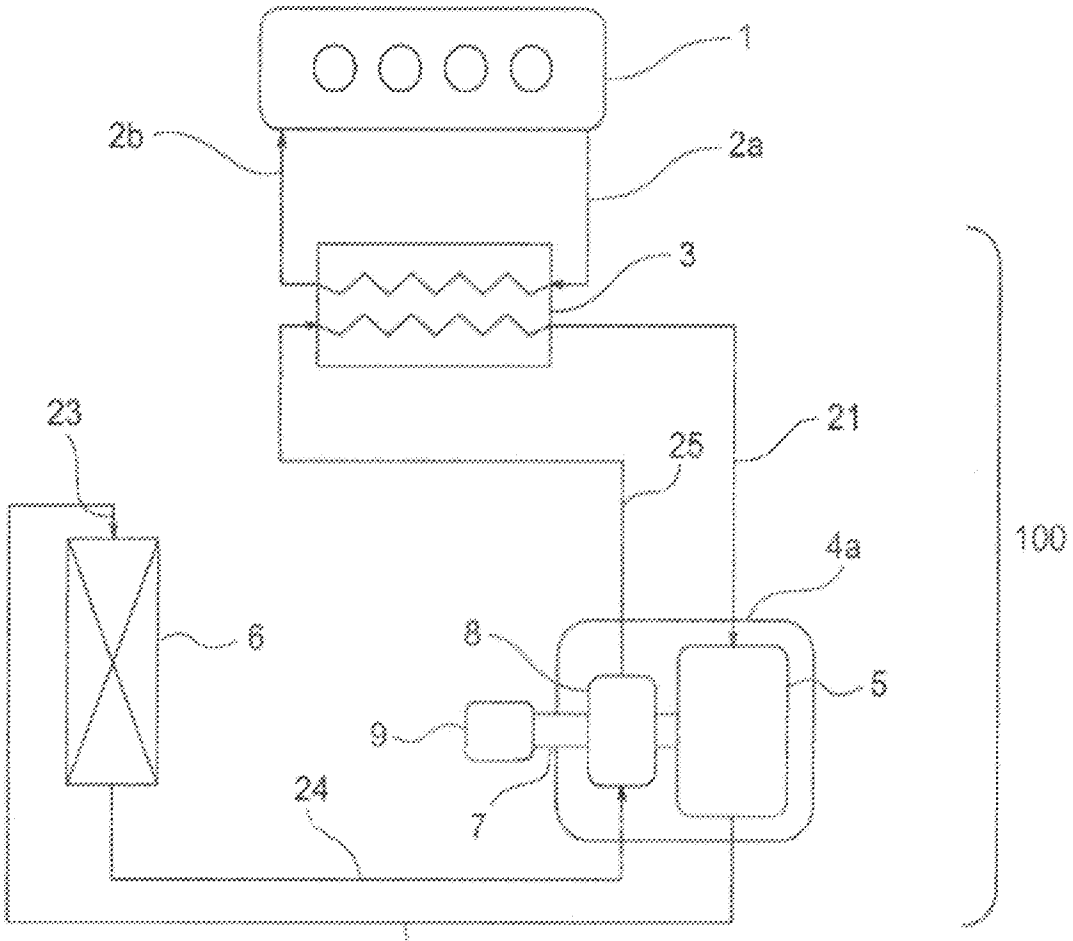
FIG. 1 A view illustrating a configuration of an exhaust heat regeneration system according to Embodiment 1 of the present invention.
Figure 2:
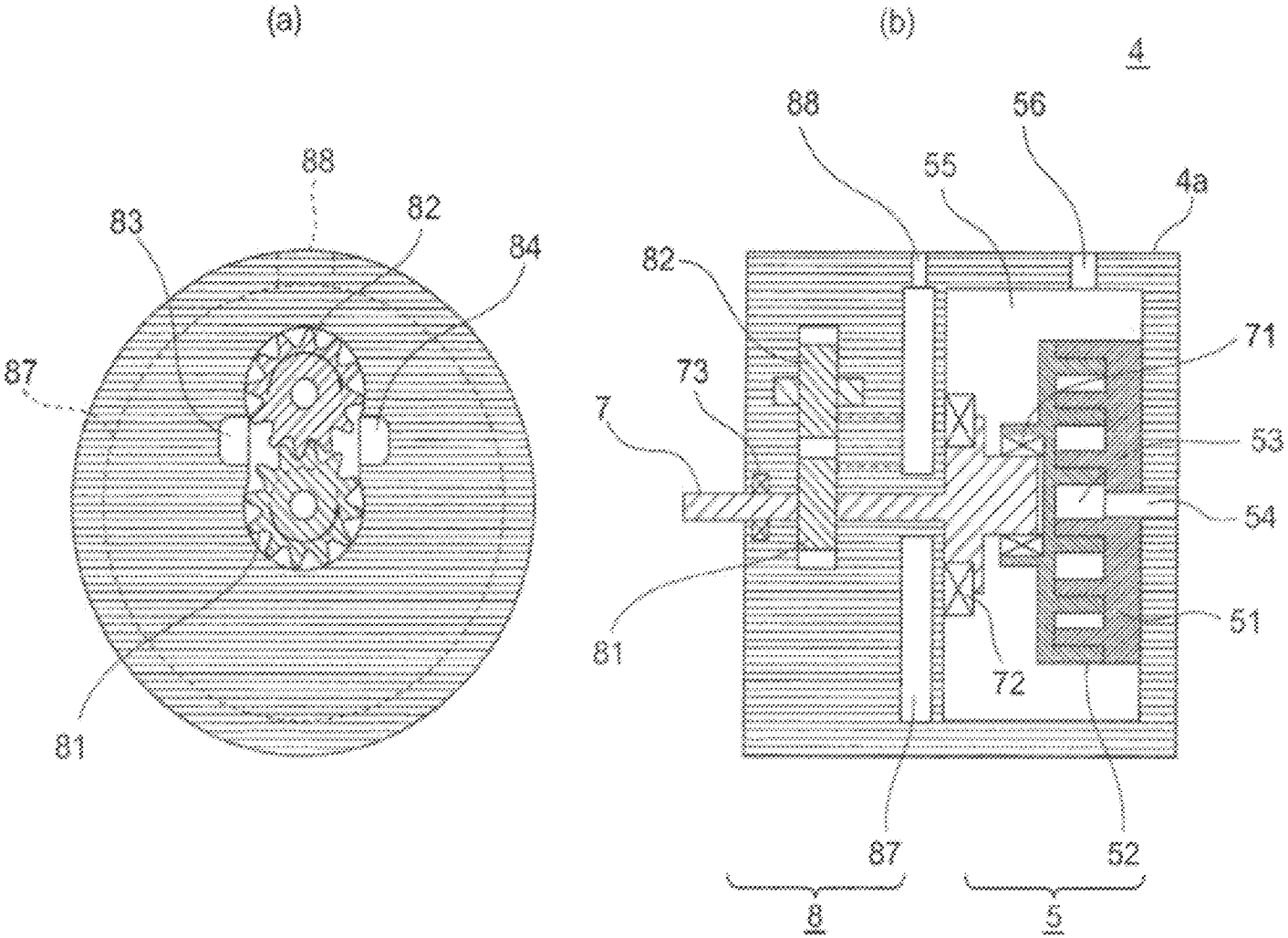
FIG. 2 Views illustrating a specific configuration of a pump-integrated type expansion device of the exhaust heat regeneration system according to Embodiment 1 of the present invention.

An exhaust heat regeneration system according to Embodiment 1 of the present invention is described referring to FIGS. 1 and 2. FIG. 1 is a view illustrating a configuration of the exhaust heat regeneration system according to Embodiment 1 of the present invention. Hereinafter, the same reference symbol denotes the same or an equivalent part in the drawings.

In FIG. 1, an engine 1 is an internal combustion engine which generates a driving force for running of an automobile. Engine cooling water heated by the engine 1 passes through a cooling-water circuit 2*a* to be cooled in an evaporator 3 and then passes through a cooling-water circuit 2*b* to be used for cooling the engine 1 again.

A Rankine cycle 100 includes the evaporator 3 for cooling engine cooling water by a refrigerant, an expansion device 5 for expanding the refrigerant which became a high-temperature high-pressure vapor, a condenser 6 for cooling and condensing the expanded refrigerant, a pump 8 coupled to the expansion device 5 by an output shaft 7, a first pipe 21 for connecting the evaporator 3 and the expansion device 5, a second pipe 22 and a third pipe 23 for connecting the expansion device 5 and the condenser 6, a fourth pipe 24 for connecting the condenser 6 and the pump 8, and a fifth pipe 25 for connecting the pump 8 and the evaporator 3.

The expansion device 5 and the pump 8 are integrated within a casing 4*a* to constitute a pump-integrated expansion device 4 which is connected to a motor-generator 9 through an intermediation of the shaft 7.

FIG. 2 are views illustrating a specific configuration of the pump-integrated type expansion device of the exhaust heat regeneration system according to Embodiment 1 of the present invention. FIG. 2(*a*) is a transverse sectional view, whereas FIG. 2(*b*) is a longitudinal sectional view. FIG. 2(*a*) is a transverse sectional view of the pump when a high-pressure chamber side is viewed from a gear section, of the longitudinal cross section of the pump-integrated type expansion device illustrated in FIG. 2(*b*).

In FIG. 2(*b*), the expansion device 5 is a scroll-type expansion device, and includes a fixed scroll 51 and a swing scroll 52 connected through an intermediation of the shaft 7 and a bearing 71. An expansion chamber 53 having a varying volume to suck and expand the refrigerant therein is formed by the fixed scroll 51 and the swing scroll 52. An inlet port 54 of the refrigerant is connected to the first pipe 21. The refrigerant after being expanded is discharged into a low-pressure space 55. An outlet 56 of the low-pressure space 55 is connected to the second pipe 22. A bearing 72 and a seal 73 are illustrated.

Meanwhile, in FIGS. 2(*a*) and 2(*b*), the pump 8 is a gear-type pump, and includes a first gear 81 connected to the shaft 7 and a second gear 82 which meshes with the first gear 81. The refrigerant on the low-pressure side is pressure-fed from an inlet port 83 to a discharge port 84 on the high-pressure side with the rotation of the first gear 81 and the second gear 82. The inlet port 83 is connected to the fourth pipe 24. A high-pressure chamber 87 formed in an annular shape between the expansion device 5 and the first gear 81 as well as the second gear 82 is connected to the discharge port 84 and is connected to the fifth pipe 25 through an outlet 88.

Next, an operation of the exhaust heat regeneration system according to Embodiment 1 is described referring to the drawings.

An operation of the Rankine cycle 100 during a normal operation is described. The Rankine cycle 100 is filled with the refrigerant such as, for example, R134a. The engine cooling water generally heated to about 90° C. to 100° C. by the engine 1 passes through the cooling-water circuit 2*a* to be cooled in the evaporator 3. In this process, the refrigerant is heated to become a high-temperature high-pressure vapor at about 90° C. The refrigerant which is now the high-temperature high-pressure vapor passes through the first pipe 5 to be delivered to the expansion device 5 and generates power in a process of expansion in the expansion device 5. The power obtained here is used for driving the automobile or for electric power generation.

The refrigerant which is now a vapor at about 60° C. after the expansion passes through the second pipe 22 and the third pipe 23 to be delivered to the condenser 6 having a cooling function by a wind caused by running of the automobile or a fan. The vapor is cooled to be condensed in the condenser 6 to become a liquid at about 30° C., which then passes through the fourth pipe 24 to be delivered to the pump 8.

The refrigerant in a liquid state is boosted by the pump 8 to have a temperature increased to about thirty and several ° C. by heat of the expansion device 5 adjacent thereto and passes through the fifth pipe 25 to be delivered to the evaporator 3. The refrigerant delivered to the evaporator 3 cools the engine cooling water generally heated to about 90° C. to 100° C. by the engine 1 and itself becomes a high-temperature high-pressure vapor at about 90° C. The engine cooling water passes through the cooling-water circuit 2*b* to be used for cooling the engine 1 again. The refrigerant repeats the above-mentioned process to continuously operate the Rankine cycle 100.

The refrigerant which is now the high-temperature high-pressure vapor at about 90° C. flows into the expansion device 5. A refrigerant vapor at about 60° C. is discharged to the low-pressure space 55. Therefore, the expansion device 5 side of the casing 4*a* generally has a high temperature of about 60° C. or higher.

On the other hand, the low-temperature refrigerant at about 30° C. discharged from the first gear 81 and the second gear 82 circulates through the interior of the high-pressure chamber 87 formed in the annular shape on the expansion device 5 side in the integrated pump 8 so as to block a heat conduction from the expansion device 5 to the first gear 81 and the second gear 82 constituting the pump 8. As a result, a temperature of the first gear 81 and the second gear 82 can be kept low so that the refrigerant can be prevented from being evaporated by heating at the inlet port 83. Thus, the Rankine cycle 100 can be continuously operated by the exhaust heat from the engine 1.

In the exhaust heat regeneration system according to Embodiment 1, which has the configuration described above, the power is generated in the expansion device 5 by the Rankine cycle 100 driven by the exhaust heat from the engine 1. As a result, the generated power is used for assisting the driving of the engine and for electric power generation, which leads to the improvement of energy efficiency such as the improvement of fuel efficiency of the automobile.

According to Embodiment 1, the exhaust heat regeneration system, into which the casing 4*a* for the pump 8 and the expansion device 5 is integrated, is configured to include the high-pressure chamber 87, through which the refrigerant flowing into the pump 8 flows, between the expansion device 5 and the first gear 81 as well as the second gear 82. In addition, the temperature of the pump 8 of the pump-integrated type expansion device 4 is prevented from being increased, while a stable operation can be performed even in the case of restart.

In the exhaust heat regeneration system according to Embodiment 1, the low-temperature refrigerant discharged from the pump 8 circulates through the interior of the high-pressure chamber 87 so as to block the heat conduction from the expansion device 5 to the first gear 81 and the second gear 82 constituting the pump 8. Therefore, the temperature of the first gear 81 and the second gear 82 can be kept low so that the refrigerant can be prevented from being evaporated by heating at the inlet port 83. Therefore, the Rankine cycle 100 can be continuously operated by the exhaust heat from the engine 1. Moreover, the power is generated in the expansion device 5 by the Rankine cycle 100 driven by the exhaust heat from the engine 1 so as to be used for assisting the driving of the engine or for electric power generation, which leads to the improvement of energy efficiency such as the improvement of fuel efficiency of the automobile.

Embodiment 2

Figure 3:
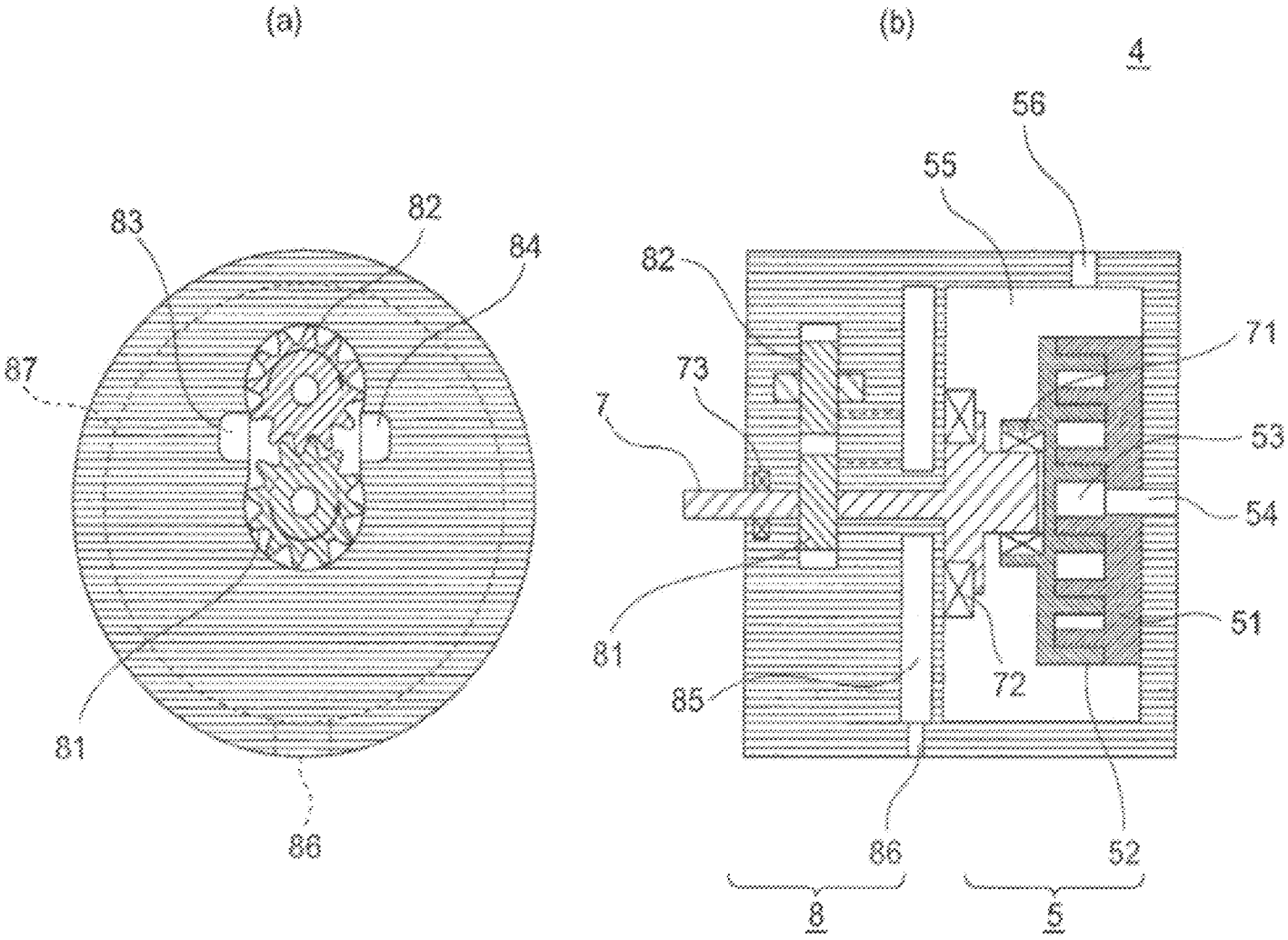
FIG. 3 Views illustrating a specific configuration of a pump-integrated type expansion device of an exhaust heat regeneration system according to Embodiment 2 of the present invention.

An exhaust heat regeneration system according to Embodiment 2 of the present invention is described referring to FIG. 3. FIG. 3 are views illustrating a specific configuration of a pump-integrated type expansion device of the exhaust heat regeneration system according to Embodiment 2 of the present invention. FIG. 3(*a*) is a transverse sectional view, whereas FIG. 3(*b*) is a longitudinal sectional view. FIG. 3(*a*) is a transverse sectional view of the pump when a low-pressure chamber side is viewed from the gear section, of the longitudinal cross section of the pump-integrated type expansion device illustrated in FIG. 3(*b*). A configuration of the exhaust heat regeneration system according to Embodiment 2 of the present invention is the same as that of Embodiment 1 described above except for the pump-integrated type expansion device. The pump-integrated type expansion device according to Embodiment 2 can also be used for exhaust heat regeneration systems according to embodiments described below.

In FIG. 3, the pump 8 has a configuration in which a low-pressure chamber 85 is provided between the expansion device 5 and the first gear 81 as well as the second gear 82 in Embodiment 2. The low-pressure chamber 85 formed in an annular shape on the expansion device 5 side with respect to the first gear 81 and the second gear 82 is connected to the inlet port 83 and is connected to the fourth pipe 24 through an intermediation of an inlet port 86. The discharge port 84 is connected to the fifth pipe 25.

The exhaust heat regeneration system according to Embodiment 2 has the configuration in which the low-pressure chamber 85 is provided between the expansion device 5 and the first gear 81 as well as the second gear 82 constituting the pump 8. As a result, a cooling effect is obtained from the low-pressure chamber 85. Therefore, the temperature of the first gear 81 and the second gear 82 can be kept low so that the refrigerant can be prevented from being evaporated by heating at the inlet port 83. Accordingly, the Rankine cycle 100 can be continuously operated by the exhaust heat from the engine 1. Moreover, the power is generated in the expansion device 5 by the Rankine cycle 100 driven by the exhaust heat from the engine 1 so as to be used for assisting the driving of the engine and for the electric power generation, which leads to the improvement of energy efficiency such as the improvement of fuel efficiency of the automobile.

According to Embodiment 2, as in the case of Embodiment 1 described above, the temperature of the pump 8 of the pump-integrated type expansion device 4 can be prevented from being increased. In addition, a stable operation can be performed even in the case of restart.

In the exhaust heat regeneration system according to Embodiment 2, the refrigerant at a low temperature, which is cooled in the condenser 6, circulates through the interior of the low-pressure chamber 85 so as to block the heat conduction from the expansion device 5 to the first gear 81 and the second gear 82 constituting the pump 8. Therefore, the temperature of the first gear 81 and the second gear 82 can be kept low to prevent the refrigerant from being evaporated by heating at the inlet port 83. Accordingly, the Rankine cycle 100 can be continuously operated by the exhaust heat from the engine 1. Moreover, the power is generated in the expansion device 5 by the Rankine cycle 100 driven by the exhaust heat from the engine 1 so as to be used for assisting the driving of the engine and for the electric power generation, which leads to the improvement of energy efficiency such as the improvement of fuel efficiency of the automobile.

In Embodiments 1 and 2 described above, the pump-integrated type expansion device 4 which is configured to house the expansion device 5 and the pump 8 within the same casing 4*a* has been described. However, the motor-generator 9 may be provided between the expansion device 5 and the pump 8, whereas the high-pressure chamber 87, the low-pressure chamber 85 in place of the high-pressure chamber 87, or both the high-pressure chamber 87 and the low-pressure chamber 85 may be provided between the pump 8 and the motor-generator 9 in the stated order from the expansion device 5 side.

Embodiment 3

Figure 4:
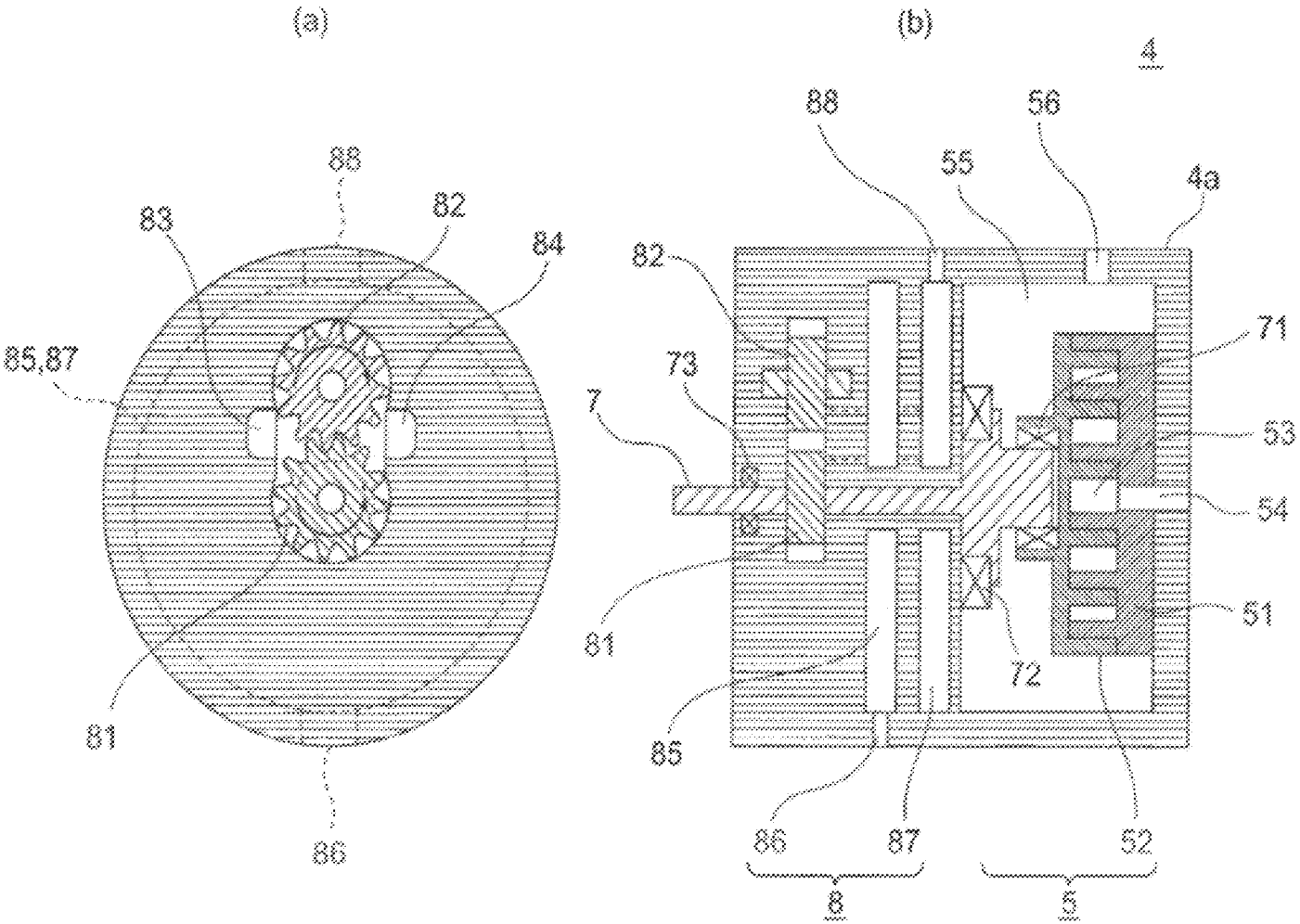
FIG. 4 Views illustrating a specific configuration of a pump-integrated type expansion device of an exhaust heat regeneration system according to Embodiment 3 of the present invention.

An exhaust heat regeneration system according to Embodiment 3 of the present invention is described referring to FIGS. 1 and 4. A configuration of the exhaust heat regeneration system according to Embodiment 3 of the present invention is the same as that of Embodiment 1 described above and illustrated in FIG. 1 except for the pump-integrated type expansion device.

In FIG. 1, an engine 1 is an internal combustion engine which generates a driving force for running of an automobile. Engine cooling water heated by the engine 1 passes through a cooling-water circuit 2*a* to be cooled in an evaporator 3 and then passes through a cooling-water circuit 2*b* to be used for cooling the engine 1 again.

A Rankine cycle 100 includes the evaporator 3 for cooling engine cooling water by a refrigerant, an expansion device 5 for expanding the refrigerant which became a high-temperature high-pressure vapor, a condenser 6 for cooling and condensing the expanded refrigerant, a pump 8 coupled to the expansion device 5 by an output shaft 7, a first pipe 21 for connecting the evaporator 3 and the expansion device 5, a second pipe 22 and a third pipe 23 for connecting the expansion device 5 and the condenser 6, a fourth pipe 24 for connecting the condenser 6 and the pump 8, and a fifth pipe 25 for connecting the pump 8 and the evaporator 3.

The expansion device 5 and the pump 8 are integrated within a casing 4*a* to constitute a pump-integrated expansion device 4 which is connected to a motor-generator 9 through an intermediation of the shaft 7.

FIG. 4 are views illustrating a specific configuration of the pump-integrated type expansion device of the exhaust heat regeneration system according to Embodiment 3 of the present invention. FIG. 4(*a*) is a transverse sectional view, whereas FIG. 4(*b*) is a longitudinal sectional view. FIG. 4(*a*) is a transverse sectional view of the pump when the high-pressure chamber side is viewed from the gear section, of the longitudinal cross section of the pump-integrated type expansion device illustrated in FIG. 4(*b*).

In FIG. 4(*b*), the expansion device 5 is a scroll-type expansion device, and includes a fixed scroll 51 and a swing scroll 52 connected through an intermediation of the shaft 7 and a bearing 71. An expansion chamber 53 having a varying volume to suck and expand the refrigerant therein is formed by the fixed scroll 51 and the swing scroll 52. An inlet port 54 of the refrigerant is connected to the first pipe 21. The refrigerant after being expanded is discharged into a low-pressure space 55. An outlet 56 of the low-pressure space 55 is connected to the second pipe 22. A bearing 72 and a seal 73 are illustrated.

Meanwhile, in FIGS. 4(*a*) and 4(*b*), the pump 8 is a gear-type pump, and includes a first gear 81 connected to the shaft 7 and a second gear 82 which meshes with the first gear 81. The refrigerant on the low-pressure side is pressure-fed from an inlet port 83 to a discharge port 84 on the high-pressure side with the rotation of the first gear 81 and the second gear 82. A low-pressure chamber 85 formed in the annular shape on the expansion device 5 side with respect to the first gear 81 and the second gear 82 is connected to the inlet port 83 and is connected to the fourth pipe 24 through an inlet port 86. A high-pressure chamber 87 formed in an annular shape between the low-pressure chamber 85 and the expansion device 5 is connected to the discharge port 84 and is connected to the fifth pipe 25 through an outlet 88.

Next, an operation of the exhaust heat regeneration system according to Embodiment 3 is described referring to the drawings.

An operation of the Rankine cycle 100 during a normal operation is described. The Rankine cycle 100 is filled with the refrigerant such as, for example, R134a. The engine cooling water generally heated to about 90° C. to 100° C. by the engine 1 passes through the cooling-water circuit 2*a* to be cooled in the evaporator 3. In this process, the refrigerant is heated to become a high-temperature high-pressure vapor at about 90° C. The refrigerant which is now the high-temperature high-pressure vapor passes through the first pipe 5 to be delivered to the expansion device 5 and generates power in a process of expansion in the expansion device 5. The power obtained here is used for driving the automobile or for electric power generation.

The refrigerant which is now a vapor at about 60° C. after the expansion passes through the second pipe 22 and the third pipe 23 to be delivered to the condenser 6 having a cooling function by a wind caused by running of the automobile or a fan. The vapor is cooled to be condensed in the condenser 6 to become a liquid at about 30° C., which then passes through the fourth pipe 24 to be delivered to the pump 8.

The refrigerant in a liquid state is boosted by the pump 8 to have a temperature increased to about thirty and several ° C. by heat of the expansion device 5 adjacent thereto and passes through the fifth pipe 25 to be delivered to the evaporator 3. The refrigerant delivered to the evaporator 3 cools the engine cooling water generally heated to about 90° C. to 100° C. by the engine 1 and itself becomes a high-temperature high-pressure vapor at about 90° C. The engine cooling water passes through the cooling-water circuit 2*b* to be used for cooling the engine 1 again. The refrigerant repeats the above-mentioned process to continuously operate the Rankine cycle 100.

The refrigerant which is now the high-temperature high-pressure vapor at about 90° C. flows into the expansion device 5. A refrigerant vapor at about 60° C. is discharged to the low-pressure space 55. Therefore, the expansion device 5 side of the casing 4*a* generally has a high temperature of about 60° C. or higher.

On the other hand, the low-temperature refrigerant at about 30° C. discharged from the first gear 81 and the second gear 82 circulates through the interior of the high-pressure chamber 87 formed in the annular shape on the expansion device 5 side in the integrated pump 8 so as to block a heat conduction from the expansion device 5 to the first gear 81 and the second gear 82 constituting the pump 8. Further, the refrigerant having a lower temperature than that of the refrigerant discharged from the pump, which is cooled in the condenser 6, flows into the low-pressure chamber 85 formed in the annular shape between the high-pressure chamber 87 and the first gear 81 as well as the second gear 82. As a result, the heat conduction to the first gear 81 and the second gear 82 constituting the pump 8 is further blocked and reduced. As a result, a temperature of the first gear 81 and the second gear 82 can be kept low so that the refrigerant can be prevented from being evaporated by heating at the inlet port 83. Thus, the Rankine cycle 100 can be continuously operated by the exhaust heat from the engine 1.

In the exhaust heat regeneration system according to Embodiment 3, which has the configuration described above, the power is generated in the expansion device 5 by the Rankine cycle 100 driven by the exhaust heat from the engine 1. As a result, the generated power is used for assisting the driving of the engine and for electric power generation, which leads to the improvement of energy efficiency such as the improvement of fuel efficiency of the automobile.

According to Embodiment 3, the exhaust heat regeneration system, into which the casing 4*a* for the pump 8 and the expansion device 5 is integrated, is configured to include the low-pressure chamber 85 through which the refrigerant flowing into the pump 8 flows and the high-pressure chamber 87 through which the discharged refrigerant flows, which are provided in the order of the high-pressure chamber 87 and the low-pressure chamber 85 from the expansion device 5 side. In addition, the temperature of the pump 8 of the pump-integrated type expansion device 4 is prevented from being increased, while a stable operation can be performed even in the case of restart.

Embodiment 4

Figure 5:
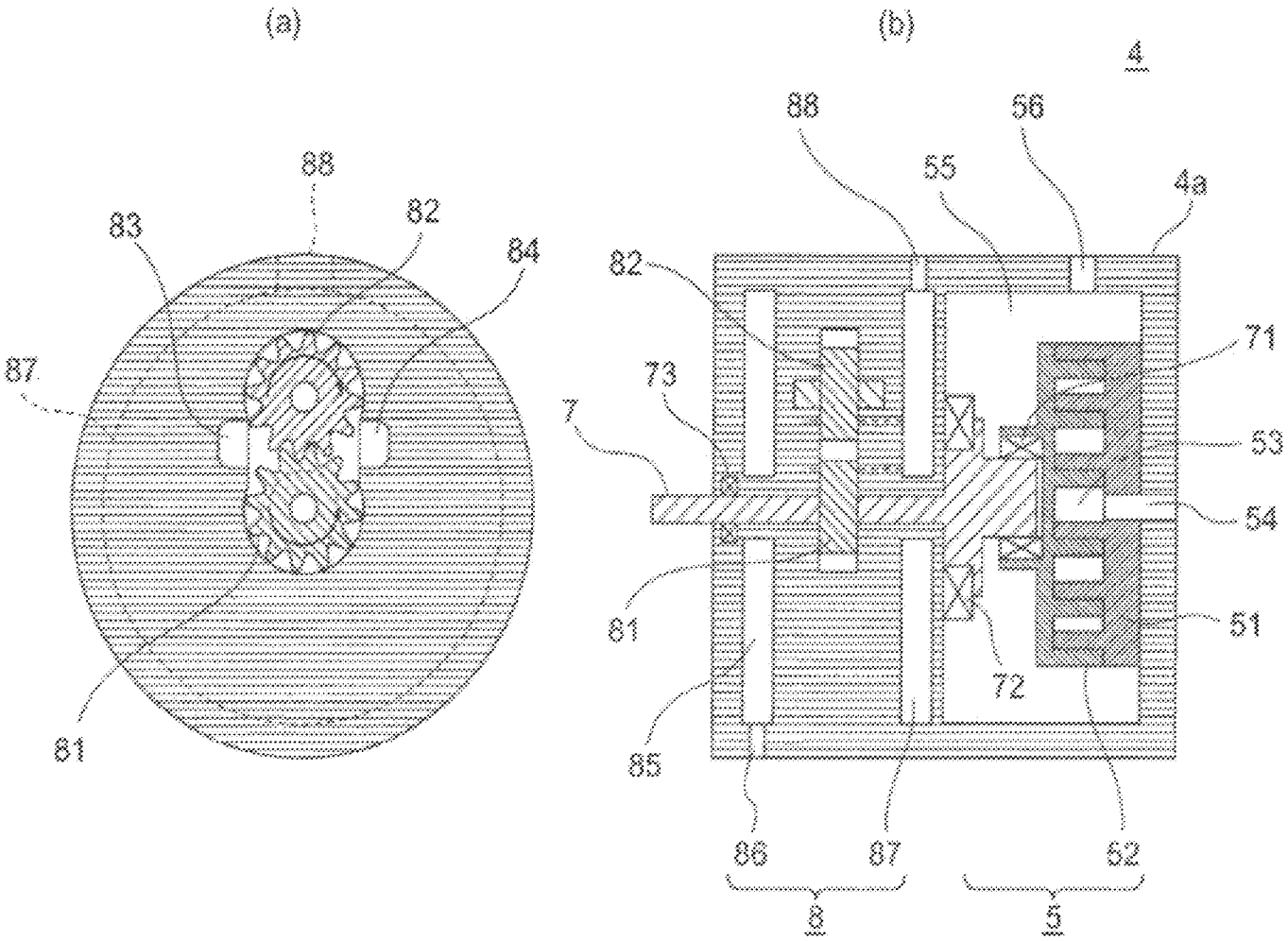
FIG. 5 Views illustrating a specific configuration of a pump-integrated type expansion device of an exhaust heat regeneration system according to Embodiment 4 of the present invention.

An exhaust heat regeneration system according to Embodiment 4 of the present invention is described referring to FIG. 5. FIG. 5 are views illustrating a specific configuration of a pump-integrated type expansion device of the exhaust heat regeneration system according to Embodiment 4 of the present invention. FIG. 5(*a*) is a transverse sectional view, whereas FIG. 5(*b*) is a longitudinal sectional view. FIG. 5(*a*) is a transverse sectional view of the pump when the high-pressure chamber side is viewed from the gear section, of the longitudinal cross section of the pump-integrated type expansion device illustrated in FIG. 5(*b*). A configuration of the exhaust heat regeneration system according to Embodiment 4 of the present invention is the same as that of Embodiment 3 described above except for the pump-integrated type expansion device. The pump-integrated type expansion device according to Embodiment 4 can also be used for exhaust heat regeneration systems according to embodiments described below.

In FIG. 5, the pump 8 includes the low-pressure chamber 85 provided on the opposite side of the expansion device 5 with respect to the first gear 81 and the second gear 82.

The exhaust heat regeneration system according to Embodiment 4 has a configuration in which the first gear 81 and the second gear 82 constituting the pump 8 are provided between the low-pressure chamber 85 and the high-pressure chamber 87. As a result, a cooling effect is obtained from both sides. Therefore, the temperature of the first gear 81 and the second gear 82 can be kept low so that the refrigerant can be prevented from being evaporated by heating at the inlet port 83. Accordingly, the Rankine cycle 100 can be continuously operated by the exhaust heat from the engine 1. Moreover, the power is generated in the expansion device 5 by the Rankine cycle 100 driven by the exhaust heat from the engine 1 so as to be used for assisting the driving of the engine and for the electric power generation, which leads to the improvement of energy efficiency such as the improvement of fuel efficiency of the automobile.

According to Embodiment 4, as in the case of Embodiment 3 described above, the temperature of the pump 8 of the pump-integrated type expansion device can be prevented from being increased. In addition, a stable operation can be performed even in the case of restart.

Embodiment 5

Figure 6:
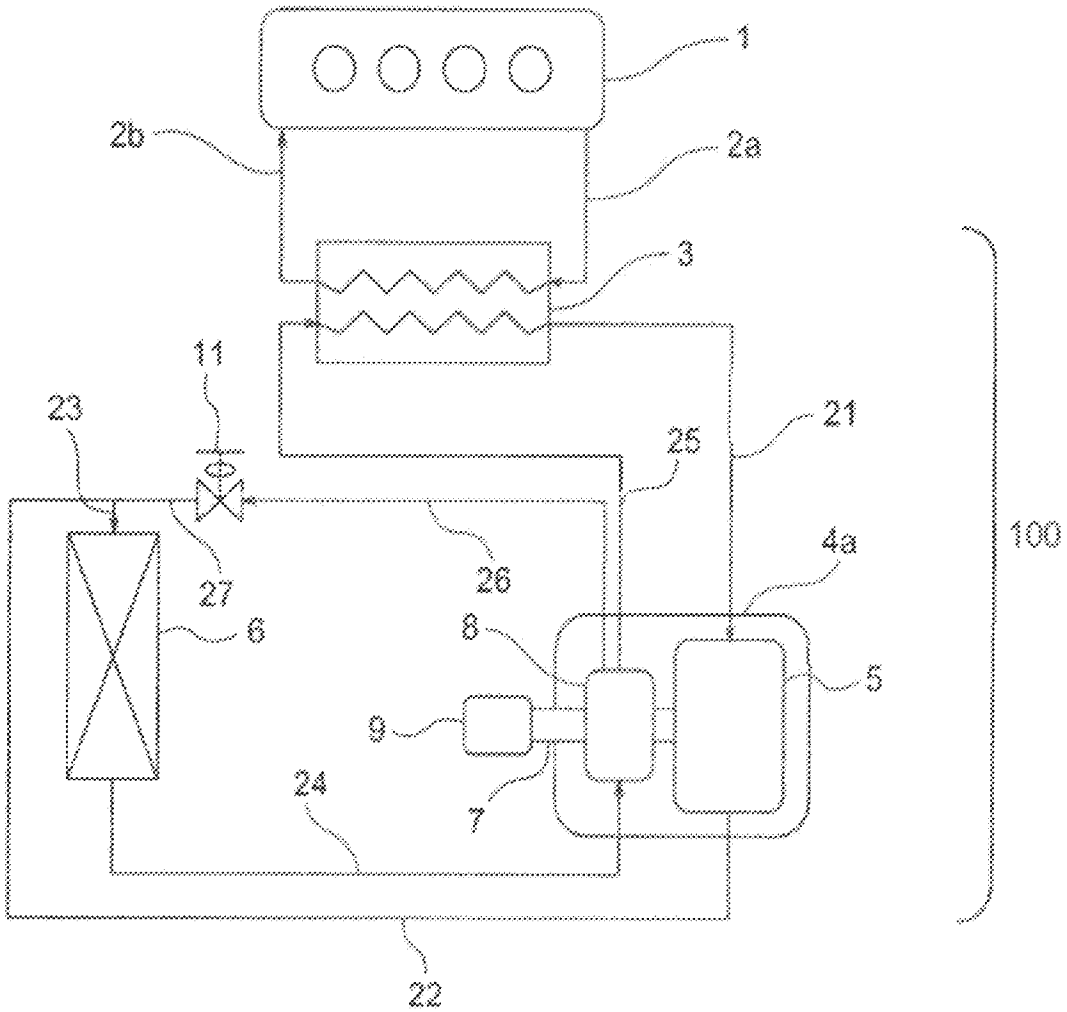
FIG. 6 A view illustrating a configuration of an exhaust heat regeneration system according to Embodiment 5 of the present invention.
Figure 7:
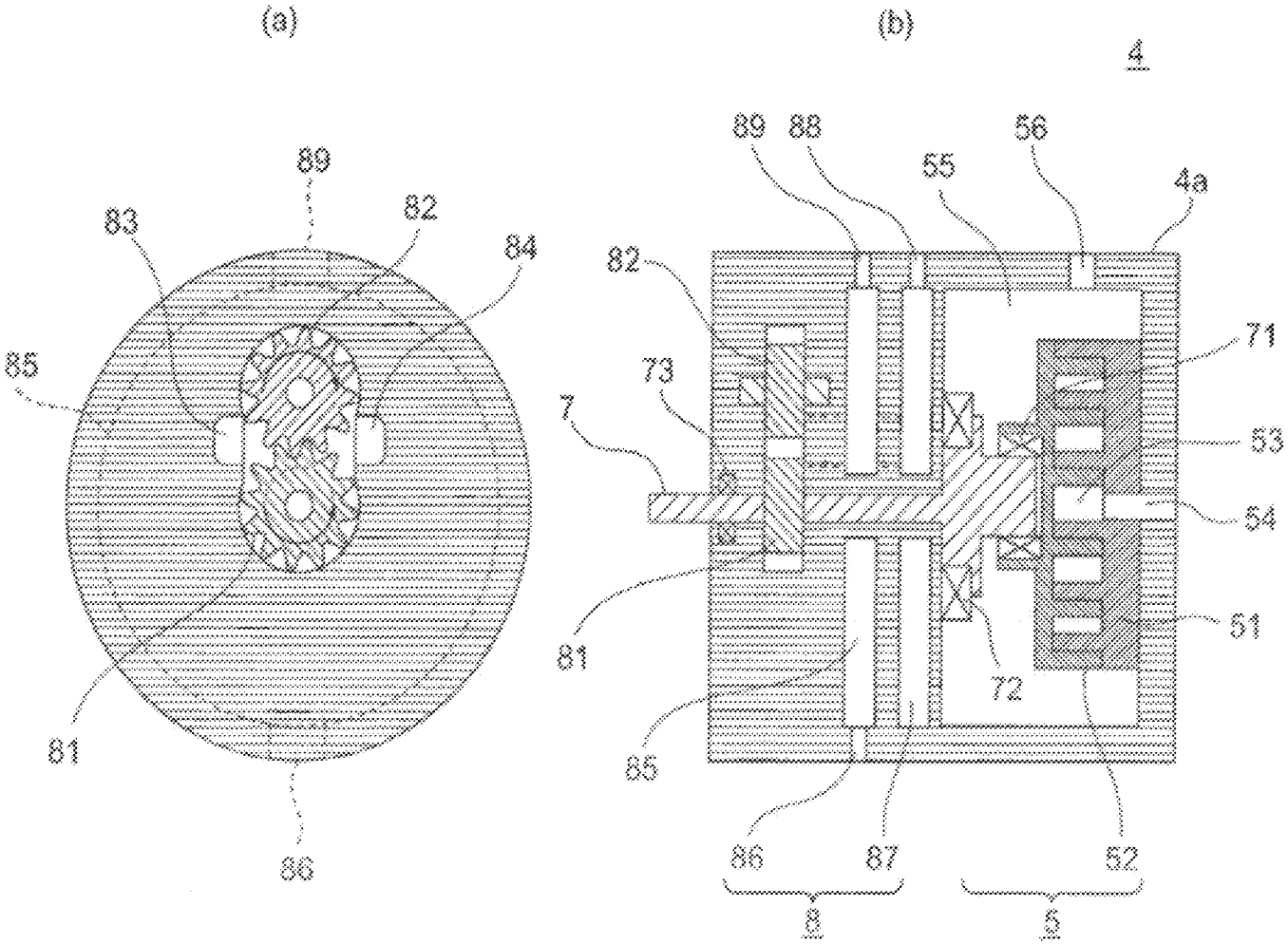
FIG. 7 Views illustrating a specific configuration of a pump-integrated type expansion device of the exhaust heat regeneration system according to Embodiment 5 of the present invention.

An exhaust heat regeneration system according to Embodiment 5 of the present invention is described referring to FIGS. 6 and 7. FIG. 6 is a view illustrating a configuration of the exhaust heat regeneration system according to Embodiment 5 of the present invention. FIG. 7 are views illustrating a specific configuration of a pump-integrated type expansion device of the exhaust heat regeneration system according to Embodiment 5 of the present invention. FIG. 7(*a*) is a transverse sectional view, whereas FIG. 7(*b*) is a longitudinal sectional view. FIG. 7(*a*) is a transverse sectional view of the pump when the high-pressure chamber side is viewed from the gear section, of the longitudinal cross section of the pump-integrated type expansion device illustrated in FIG. 7(*b*), from which the illustration of the high-pressure chamber and an outlet thereof is omitted.

In FIGS. 6 and 7, the pump 8 is configured to be connected to the condenser 6 through an intermediation of a sixth pipe 26, an on-off valve 11, a seventh pipe 27, and the third pipe 23, and is connected to the sixth pipe 26 through an intermediation of an outlet 89 formed on the side (in an upper part illustrated in FIG. 7(*b*)) opposite to the inlet port 86 (in a lower part illustrated in FIG. 7(*b*)) of the low-pressure chamber 85 in Embodiment 5. In FIG. 7(*a*), the low-pressure chamber 85, the inlet port 86, and the outlet 89 are indicated by broken lines.

The operation and effects of the Rankine cycle 100 during the normal operation when the on-off valve 11 is closed are the same as those of Embodiment 3 described above. The power is generated in the expansion device 5 by the Rankine cycle 100 driven by the exhaust heat from the engine 1 so as to be used for assisting the driving of the engine and for electric power generation, which leads to the improvement of energy efficiency such as the improvement of fuel efficiency of the automobile.

Next, an operation in the case where the engine 1 stops is described.

In FIG. 6, the pump 8 is provided so as to be located in the vicinity of a lowermost part (herein, the "vicinity of the lowermost part" specifically means a part below a position corresponding to the lowest one-third of the overall height direction of the condenser 6) relative to the condenser 6.

When the Rankine cycle 100 is stopped with the stop of the engine 1, the on-off valve 11 is opened by control of an electronic control unit (ECU) (not shown). When the temperature of the pump 8 is increased by the heat conduction from the expansion device 5 side to evaporate and vaporize the refrigerant present in the low-pressure chamber 85, the evaporated and vaporized refrigerant flows into the condenser 6 through the sixth pipe 26, the on-off valve 11, the seventh pipe 27, and the third pipe 23 due to a difference in density between the liquid and the gas so as to be cooled to be liquefied and then returns to the low-pressure chamber 85 again to perform a natural circulation. As a result, the low-pressure chamber 85 is filled with the low-temperature liquid refrigerant. Therefore, in the exhaust heat regeneration system according to Embodiment 5 of the present invention, even without an external power source, an increase in temperature of the pump 8 can be suppressed, while efficient cooling can be performed. Therefore, at the restart of the Rankine cycle 100, the pump 8 can be operated. Thus, the exhaust heat regeneration system can be operated stably.

Opening/closing of the on-off valve 11 is controlled so that the on-off valve 11 is opened with the stop of the operation of the Rankine cycle 100 and the on-off valve 11 is closed with the start of the engine 1 or the start of the operation of the Rankine cycle 100.

According to Embodiment 5, the exhaust heat regeneration system, into which the casing 4*a* for the pump 8 and the expansion device 5 is integrated, includes the low-pressure chamber 85 through which the refrigerant flowing into the pump 8 flows and the high-pressure chamber 87 through which the discharged refrigerant flows, which are provided in the order of the high-pressure chamber 87 and the low-pressure chamber 85 from the expansion device 5 side. In addition, the low-pressure chamber 85 and the condenser 6 are configured so that the refrigerant can circulate through an intermediation of the on-off valve 11. Therefore, the temperature of the pump 8 of the pump-integrated type expansion device 4 can be prevented from being increased. In addition, when the temperature of the pump 8 is increased, quick cooling can be performed. As a result, a stable operation can be performed even in the case of the restart.

Embodiment 6

Figure 8:
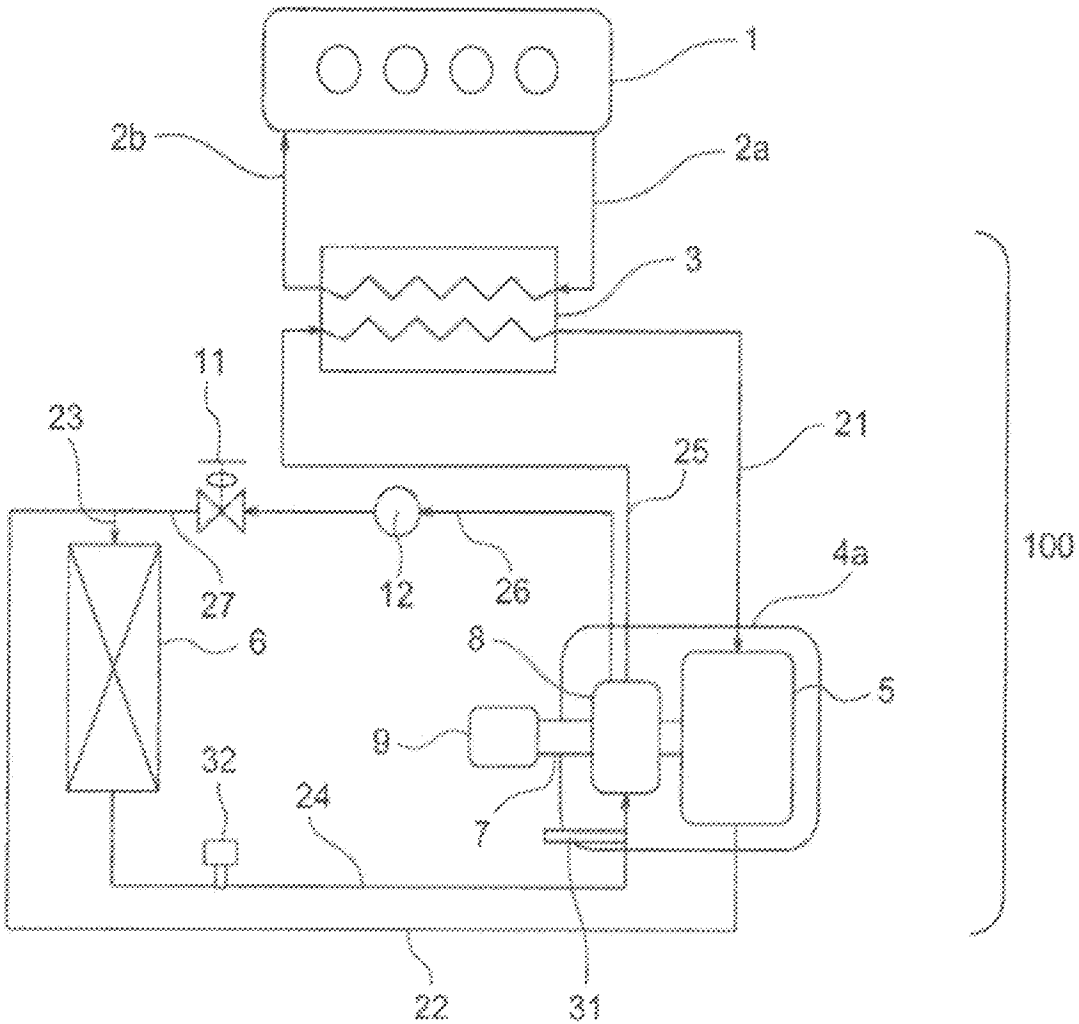
FIG. 8 A view illustrating a configuration of an exhaust heat regeneration system according to Embodiment 6 of the present invention.

An exhaust heat regeneration system according to Embodiment 6 of the present invention is described referring to FIGS. 8 to 11. FIG. 8 is a view illustrating a configuration of the exhaust heat regeneration system according to Embodiment 6 of the present invention.

In FIG. 8, in addition to the configuration of Embodiment 5 described above, a second pump 12 is provided to the sixth pipe 26 in Embodiment 6.

The opening/closing of the on-off valve 11 and an operation of the second pump 12 can be easily controlled by providing a sensor for measuring a pressure and a temperature of the refrigerant at the inlet of the pump 8, a temperature of the casing of the pump 8 and the vicinity thereof, a flow rate of the refrigerant and an operating frequency of the pump 8, or the like and obtaining a correlation between the stop of the operation of the Rankine cycle 100 and the above-mentioned values.

FIG. 8 illustrates the case where a temperature sensor 31 for measuring the temperature of the refrigerant in the vicinity of the inlet of the pump 8 and a pressure sensor 32 for measuring the pressure of the fourth pipe 24 connected at the above-mentioned position are provided. For example, a thermistor or a thermocouple is considered to be used as the temperature sensor 31, whereas a resistance strain gauge type pressure sensor is considered to be used as the pressure sensor 32.

Figure 9:
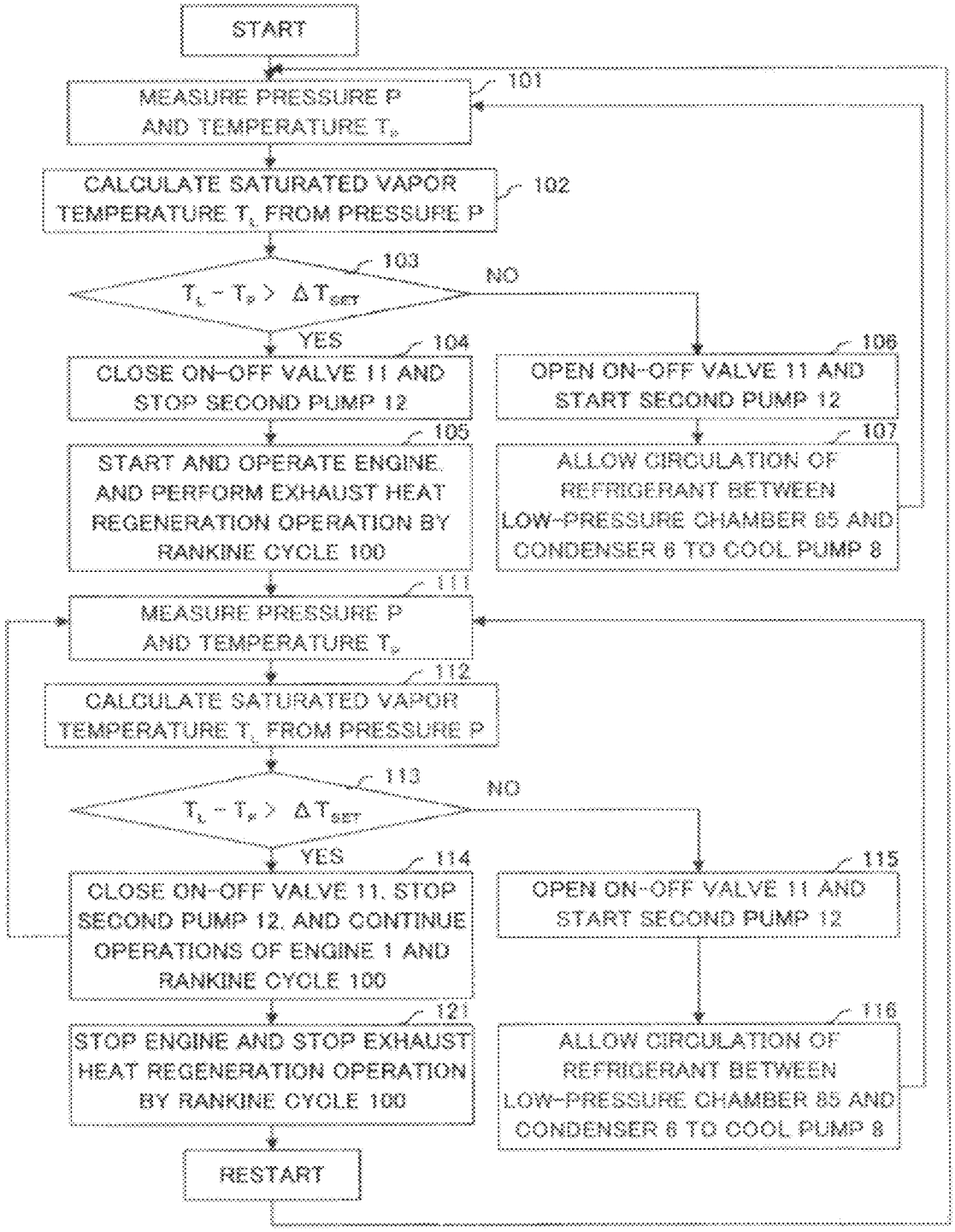
FIG. 9 A flowchart illustrating an operation of the exhaust heat regeneration system according to Embodiment 6 of the present invention.

FIG. 9 is a flowchart illustrating an operation of the exhaust heat regeneration system according to Embodiment 6 of the present invention. FIG. 9 is a flowchart of a system operation using measurement values of a temperature $T_P$ and a pressure P of the refrigerant in the vicinity of the inlet of the pump 8, obtained by the temperature sensor 31 and the pressure sensor 32. Hereinafter, one specific example of system control is described with FIG. 9.

First, the ECU (not shown) uses the temperature sensor 31 and the pressure sensor 32 to measure the temperature $T_P$ and the pressure P of the refrigerant in the vicinity of the inlet of the pump 8 (Step 101). A saturated vapor temperature $T_L$ at the pressure P of the used refrigerant is calculated (Step 102). When a value $T_L-T_P$ is larger than a preset temperature difference $\Delta T_{SET}$ (YES), the on-off valve 11 is closed to start the engine 1 to start the operation. At the same time, the Rankine cycle 100 is operated to generate the power by the expansion device 5 (Step 103).

On the other hand, when the temperature $T_P$ of the refrigerant in the vicinity of the inlet of the pump 8 is increased and the value $T_L-T_P$ is equal to or smaller than the preset temperature difference $\Delta T_{SET}$ (NO), the on-off valve 11 is opened to operate the second pump 12 so that the refrigerant in the low-pressure chamber 85 is delivered to the condenser 6 (Steps 103, 106, and 107). In this case, the refrigerant is efficiently cooled in the condenser 6 and then returns to the low-pressure chamber 85 without a heating process in the evaporator 3. At the same time, the refrigerant is not delivered to the evaporator 3. Therefore, the refrigerant at a high temperature does not flow into the expansion device 5 through the circulation.

Therefore, an increase in temperature of the pump 8 due to the effects of heating in the expansion device 5 does not occur, and therefore the pump 8 is extremely efficiently cooled. Thereafter, the measurement of the temperature $T_P$ and the pressure P of the refrigerant in the vicinity of the inlet of the pump 8 by the temperature sensor 31 and the pressure sensor 32 is repeated at predetermined intervals. When the value $T_L-T_P$ becomes larger than the preset temperature difference $\Delta T_{SET}$, the engine 1 is started to be operated.

Even during the operations of the engine 1 and the Rankine cycle 100, the measurement of the temperature $T_P$ and the pressure P of the refrigerant in the vicinity of the inlet of the pump 8 by the temperature sensor 31 and the pressure sensor 32 is repeated at predetermined intervals. When the value $T_L-T_P$ becomes equal to or smaller than the preset temperature difference $\Delta T_{SET}$, the on-off valve 11 is opened to operate the second pump 12 so that the refrigerant in the low-pressure chamber 85 is delivered to the condenser 6 (Steps 111 to 113, 115, and 116). In this case, the refrigerant is efficiently cooled in the condenser 6 and then returns to the pump 8 without the heating process in the evaporator 3. At the same time, the refrigerant is not delivered to the evaporator 3. Therefore, the refrigerant at a high temperature does not flow into the expansion device 5 through the circulation.

Therefore, an increase in temperature of the pump 8 due to the effect of heating in the expansion device 5 does not occur, and hence the pump 8 is extremely efficiently cooled. When the value $T_L-T_P$ becomes larger than the preset temperature difference $\Delta T_{SET}$ again, the on-off valve 11 is closed and the operation of the second pump 12 is stopped. Then, the engine 1 and the Rankine cycle 100 continue the normal operations again (Steps 113 and 114). In theory, a higher Rankine cycle efficiency can be obtained when $\Delta T_{SET}$ is set as small as possible in the range of 0° C. and larger. For a stable operation, however, $\Delta T_{SET}$ is generally set to about 5° C.

If the setting for performing switching within a short period of time is used to reduce a time period in which the refrigerant is not delivered to the evaporator 3, a time period in which the engine cooling water increases can be kept short. In addition, a load on the engine 1 is small. By performing the system control described above, it is assumed that a slight fluctuation occurs in the temperature of the engine cooling water. However, it is apparent that the effects, in particular, on the engine 1 can be prevented by performing the control within the range of a safe temperature.

Figure 10:
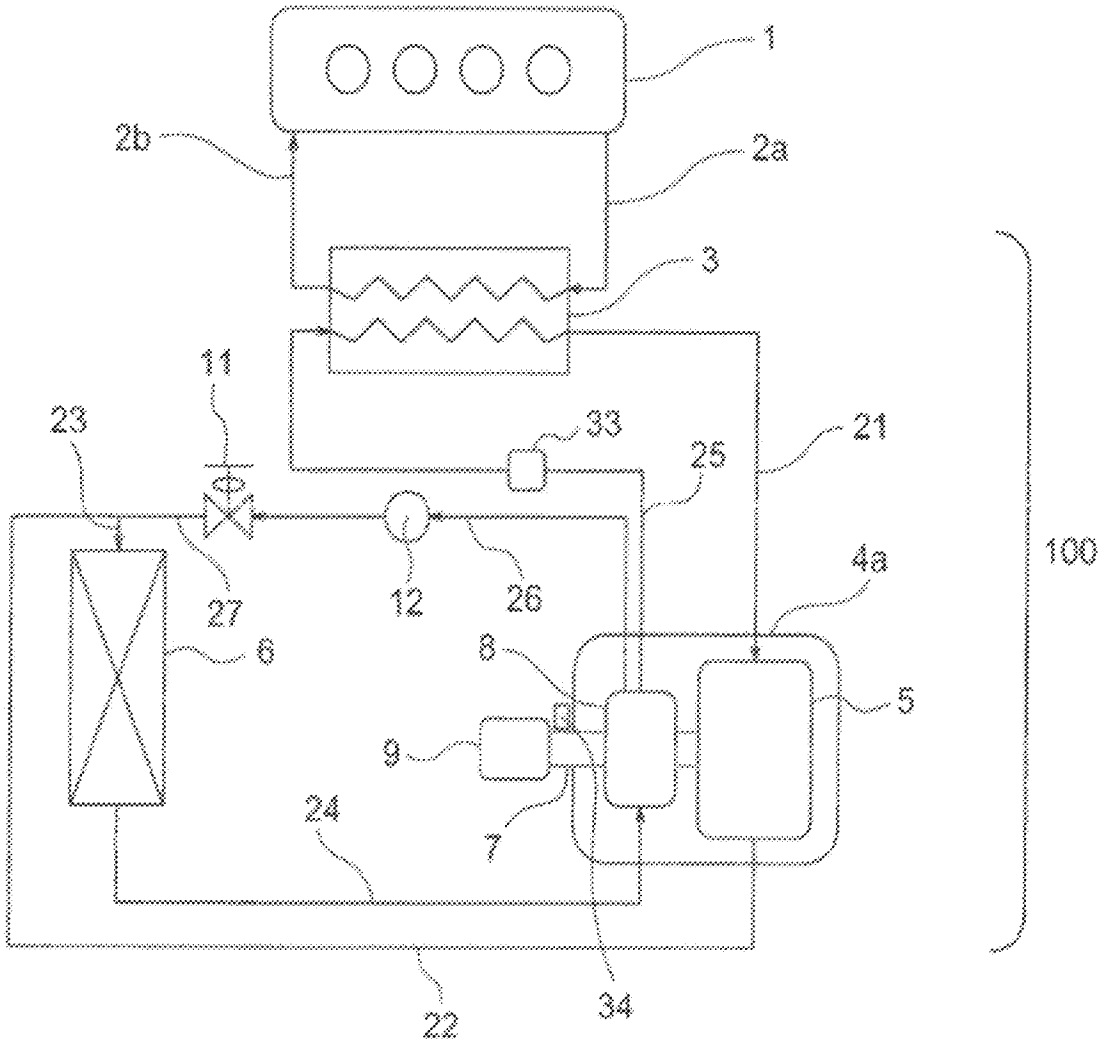
FIG. 10 A view illustrating another configuration of the exhaust heat regeneration system according to Embodiment 6 of the present invention.

In the description given above, the example of the control of the opening/closing of the on-off valve 11 and the operation of the second pump 12, performed based on the pressure and the temperature of the refrigerant, is described. As illustrated in FIG. 10, however, the flow rate of the refrigerant and the operating frequency of the pump 8 may be measured respectively by a flow-rate sensor 33 and a frequency sensor 34 so that the control is performed on the obtained values.

FIG. 10 is a view illustrating another configuration of the exhaust heat regeneration system according to Embodiment 6 of the present invention. In FIG. 10, the flow-rate sensor 33 is provided to the fifth pipe 25 at an arbitrary position so as to measure a flow rate of the refrigerant flowing through the fifth pipe 35. The frequency sensor 34 detects the number of revolutions of the output shaft 7 coupled to the pump 8 per unit time.

In general, the flow rate of the refrigerant can be uniquely calculated from the operating frequency of the pump 8. It is determined that the pump 8 now has a high temperature when an error $(Q_0-Q)/Q_0$ between a flow rate Q measured by the flow-rate sensor 33 and a flow rate $Q_0$ calculated from the frequency measured by the frequency sensor 34 becomes a value larger than a preset flow-rate error $\Delta Q_{SET}$. The determination is performed in the same manner as in the case where the value $T_L-T_P$ becomes equal to or smaller than the preset temperature difference $\Delta T_{SET}$ by the control of opening/closing of the on-off valve 11 and the control of the operation of the second pump 12 based on the pressure and the temperature of the refrigerant described above. As a result, the operation can be performed in the same manner as illustrated in the flowchart of FIG. 9. A remaining part of the method of system control is the same as that of the method of system control performed based on the pressure and the temperature of the refrigerant described above. Therefore, the description thereof is herein omitted. Here, $\Delta Q_{SET}$ is generally set to a value larger than about 0.05.

Figure 11:
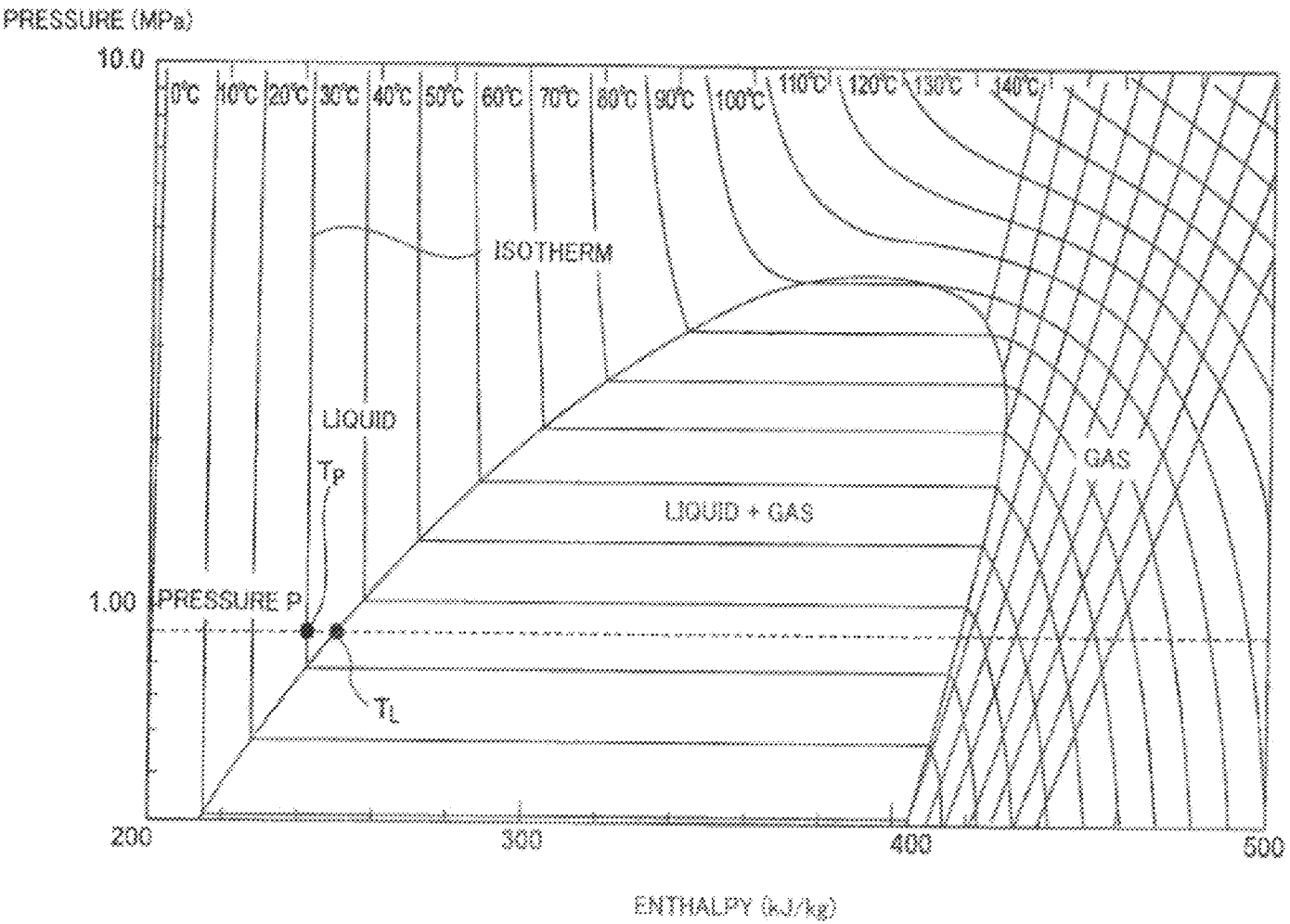
FIG. 11 A Mollier chart when R134a is used as a refrigerant for the exhaust heat regeneration system according to Embodiment 6 of the present invention.

FIG. 11 is a Mollier chart when R134a is used as the refrigerant. In FIG. 11, when the pressure and the pressure are obtained, which of three states the refrigerant is in, specifically, a liquid state, a gas state, and a state in which the liquid and the gas mix, can be determined. In the method of system control performed based on the pressure and the temperature of the refrigerant illustrated in FIG. 9, it can be easily determined by using FIG. 11 that the relation among the pressure P when, for example, R134a is used as the refrigerant, the temperature $T_P$ of the refrigerant in the vicinity of the inlet of the pump 8, and the saturated vapor temperature $T_L$ at the pressure P, is as illustrated in FIG. 11, corresponding to the specific refrigerant (R134a in this case).

In a general method of system control, when it is determined that the refrigerant is in the gas state or in the state where the liquid and the gas mix, it can be determined that the pump 8 has a high temperature. Moreover, even when the refrigerant is in the liquid state, a likelihood of determination of the high temperature of the pump 8, specifically, a likelihood of determination of a temperature at which the refrigerant is evaporated and vaporized in the pump 8 can be obtained by evaluating a difference with a measurement value. Therefore, the pump 8 is cooled in advance at the time when the temperature reaches a preset temperature. As a result, the Rankine cycle 100 can be operated constantly stably.

Moreover, as described above, the flow rate of the pump 8 can be calculated and evaluated uniquely based on the operating frequency from characteristics thereof. When the Rankine cycle 100 is operated normally, the flow rate calculated from the operating frequency and a measurement value of the flow rate of the refrigerant circulating through the Rankine cycle 100 are approximately identical with each other. Therefore, when a difference in flow rate therebetween becomes equal to or larger than a preset value, it is determined that the pump 8 has a high temperature to enable the cooling of the pump 8. As a result, the Rankine cycle 100 can be operated stably.

Even when it is difficult to directly measure values such as the above-mentioned temperature of the refrigerant in the vicinity of the inlet of the pump 8, so-called those skilled in the art can easily obtain the values by using a correlation between a temperature of a radiator and a temperature of a fluid and the like. It is apparent that the positions at which the sensors are provided are a design problem, and therefore the positions differ depending on an engine structure or the like.

In the exhaust heat regeneration system according to Embodiment 6 of the present invention, the refrigerant circulates through the low-pressure chamber 85 of the pump 8 and the condenser 6. As a result, a remarkable cooling effect of the pump 8 can be demonstrated. As a result, the pump 8 can be generally cooled within a short period of time corresponding to one minute. Thus, even when the control is performed based on the measurement values obtained by the sensors, cooling can be immediately performed in response thereto. Therefore, an engine failure due to seizing of a piston or the like does not occur.

In the description given above, the case where the second pump 12 is provided to the sixth pipe 26 has been described. However, the second pump 12 may be provided to the seventh pipe 27, which still provides the same effects.

Further, in the description given above, the case where both the on-off valve 11 and the second pump 12 are used has been described. However, the flow of the refrigerant can be stopped by stopping the second pump 12 with the use of a positive-displacement pump such as the gear-type pump as the second pump 12. Therefore, the on-off valve 11 may be omitted, which still provides the same effects.

According to Embodiment 6, the same effects as those of each of the embodiments described above can be produced. Further, by providing the second pump 12, the refrigerant can be forcibly circulated through the low-pressure chamber 85 and the condenser 6. As a result, the pump 8 constituting the Rankine cycle can be efficiently cooled regardless of the operation/non-operation of the engine 1 and the Rankine cycle 100. As a result, the temperature of the pump 8 of the pump-integrated type expansion device 4 can be more efficiently prevented from being increased. In addition, when the temperature of the pump 8 is increased, cooling can be quickly performed. Thus, a stable operation can be performed even in the case of restart.

Embodiment 7

Figure 12:
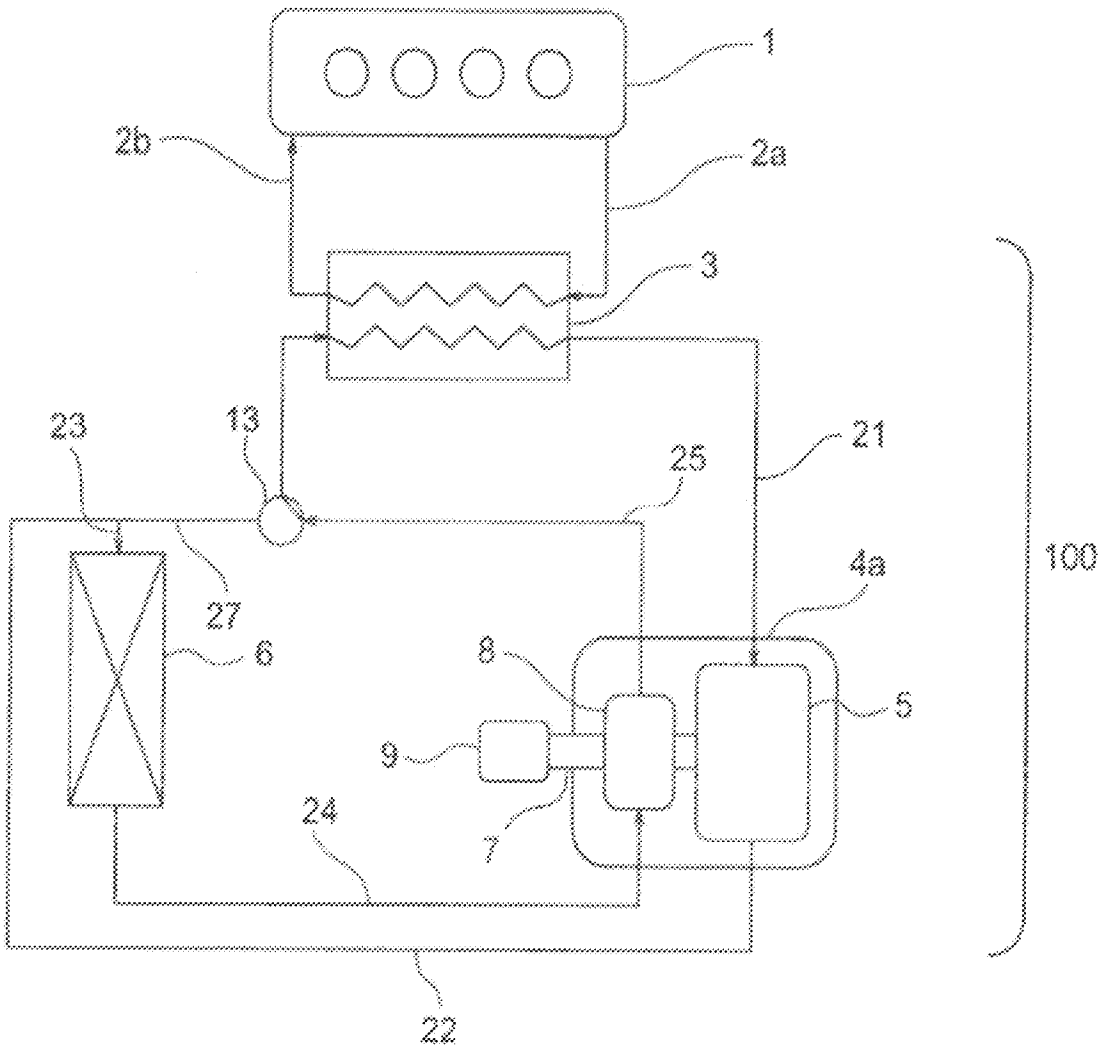
FIG. 12 A view illustrating a configuration of an exhaust heat regeneration system according to Embodiment 7 of the present invention.

An exhaust heat regeneration system according to Embodiment 7 of the present invention is described referring to FIG. 12. FIG. 12 is a view illustrating a configuration of the exhaust heat regeneration system according to Embodiment 7 of the present invention.

In FIG. 12, a three-way valve 13 for switching a flow path of the refrigerant is provided in the middle of the fifth pipe 25 which connects the pump 8 and the evaporator 3 to each other in Embodiment 7. The pump 8 is configured to be connected to the condenser 6 through an intermediation of the fifth pipe 25, the three-way valve 13, and the seventh pipe 27.

The operation and effects of the Rankine cycle 100 during the normal operation in which the refrigerant discharged from the pump 8 is delivered to the evaporator 3 through an intermediation of the three-way valve 13 are the same as those of Embodiment 3 described above. The power is generated in the expansion device 5 by the Rankine cycle 100 driven by the exhaust heat from the engine 1 so as to be used for assisting the driving of the engine, the electric power generation, or the like, which leads to the improvement of energy efficiency such as the improvement of fuel efficiency of the automobile.

Next, an operation performed when the temperature of the pump 8 increases to evaporate and vaporize the refrigerant at the inlet of the pump 8 to make it difficult to circulate the refrigerant by boosting to disable the operation of the Rankine cycle 100 is described.

In the above-mentioned case, the three-way valve 13 is switched so that the fifth pipe 25 connected to the pump 8, and the seventh pipe 27 and the third pipe 23 connected to the condenser 6 are brought into communication with each other. In this manner, all the refrigerant discharged from the pump 8 is delivered to the condenser 6. As a result, the refrigerant is efficiently cooled in the condenser 6 and then returns to the pump 8 without the heating process in the evaporator 3. In addition, the refrigerant is not delivered to the evaporator 3. Therefore, the refrigerant at the high temperature does not flow into the expansion device 5 through the circulation. Therefore, an increase in temperature of the pump 8 due to the effects of heating in the expansion device 5 does not occur, and therefore the pump 8 is extremely efficiently cooled. In this case, the power cannot be obtained by the Rankine cycle 100. Thus, the pump 8 is driven by the motor-generator 9 or the like coupled to the output shaft 7.

In the case where the temperature of the pump 8 increases to evaporate and vaporize the refrigerant at the inlet of the pump 8 to make it difficult to circulate the refrigerant by boosting to disable the operation of the Rankin cycle 100 as described above, the operation of the three-way valve 13 is switched. As a result, the pump 8 is efficiently cooled to enable the operation of the pump 8 within a short period of time. Thus, the Rankine cycle 100 can be operated stably for a long period of time, which leads to the further improvement of energy efficiency such as the improvement of fuel efficiency of the automobile.

Further, the case where, for example, the engine 1 stops to stop the operation of the Rankine cycle 1 in response thereto, to thereby increase the temperature of the pump 8 is assumed. Even in such a case, the three-way valve 13 is switched so that the refrigerant discharged from the pump 8 can flow into the condenser 6, thereby circulating the efficiently cooled refrigerant through the pump 8. As a result, the vicinity of the pump 8 is cooled quickly (in general, within about several minutes). Thereafter, when the engine 1 is restarted, the three-way valve 13 is switched so that the refrigerant discharged from the pump 8 can flow into the evaporator 3. As a result, a condition in which the Rankine cycle 100 is stopped at the very start of the engine 1 can be avoided. Therefore, the Rankine cycle 100 can be efficiently operated.

The switching control of the three-way valve 13 herein can be easily carried out by, similarly to the opening/closing control of the on-off valve 11 in Embodiment 6 described above, providing a sensor for measuring the pressure and the temperature of the refrigerant at the inlet of the pump 8, a temperature of the casing of the pump 8 or the vicinity thereof, or the flow rate of the refrigerant and the operating frequency of the pump 8 so as to obtain a correlation between the stop of the operation of the Rankine cycle 100 and the above-mentioned values.

According to Embodiment 7, in the exhaust heat regeneration system, into which the casing 4*a* for the pump 8 and the expansion device 5 is integrated, the refrigerant discharged from the pump 8 by switching the three-way valve 13 is delivered to the condenser 6 so as to be cooled and then circulates to flow into the pump 8. Therefore, the temperature of the pump 8 of the pump-integrated type expansion device 4 can be prevented from being increased. In addition, when the temperature of the pump 8 is increased, the cooling can be quickly performed. As a result, a stable operation can be performed even in the case of restart.

Embodiment 8

Figure 13:
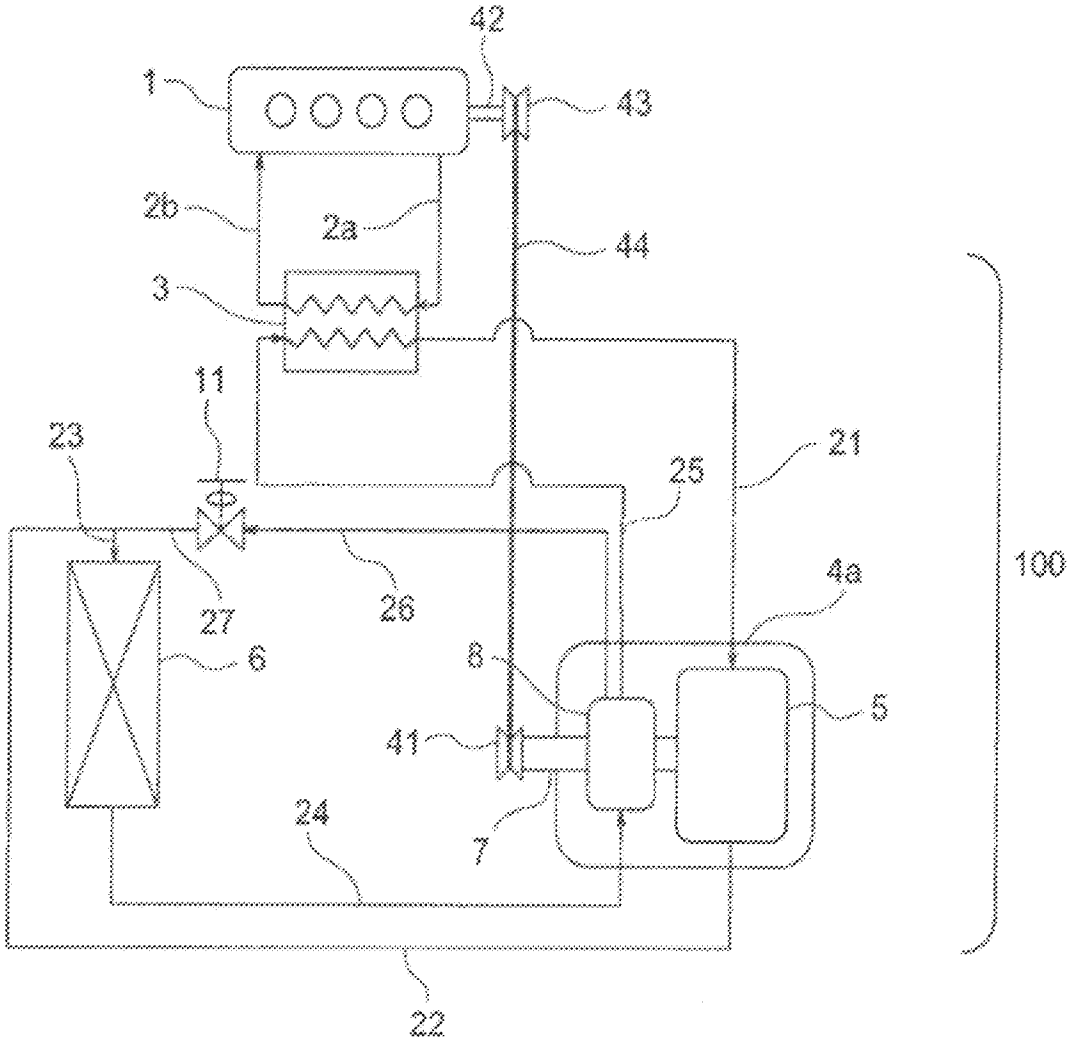
FIG. 13 A view illustrating a configuration of an exhaust heat regeneration system according to Embodiment 8 of the present invention.

An exhaust heat regeneration system according to Embodiment 8 of the present invention is described referring to FIG. 13. FIG. 13 is a view illustrating a configuration of the exhaust heat regeneration system according to Embodiment 8 of the present invention.

In each of the embodiments described above, the configuration in which the motor-generator 9 is coupled to the output shaft 7 of the Rankine cycle 100 so that electric power is generated or the expansion device 5 and the pump 8 are driven forcibly by the output of the expansion device 5 is described. In Embodiment 8, as illustrated in FIG. 13, in place of the motor-generator 9, a first pulley 41 provided to the output shaft 7 and a second pulley 43 provided to an engine output shaft 42 of the engine 1 may be connected to each other through a belt 44 so that the output of the expansion device 5 is used for assisting the driving of the engine 1 coupled thereto or the pump 8 and the expansion device 5 are forcibly driven by the output of the engine 1.

Embodiment 9

Figure 14:
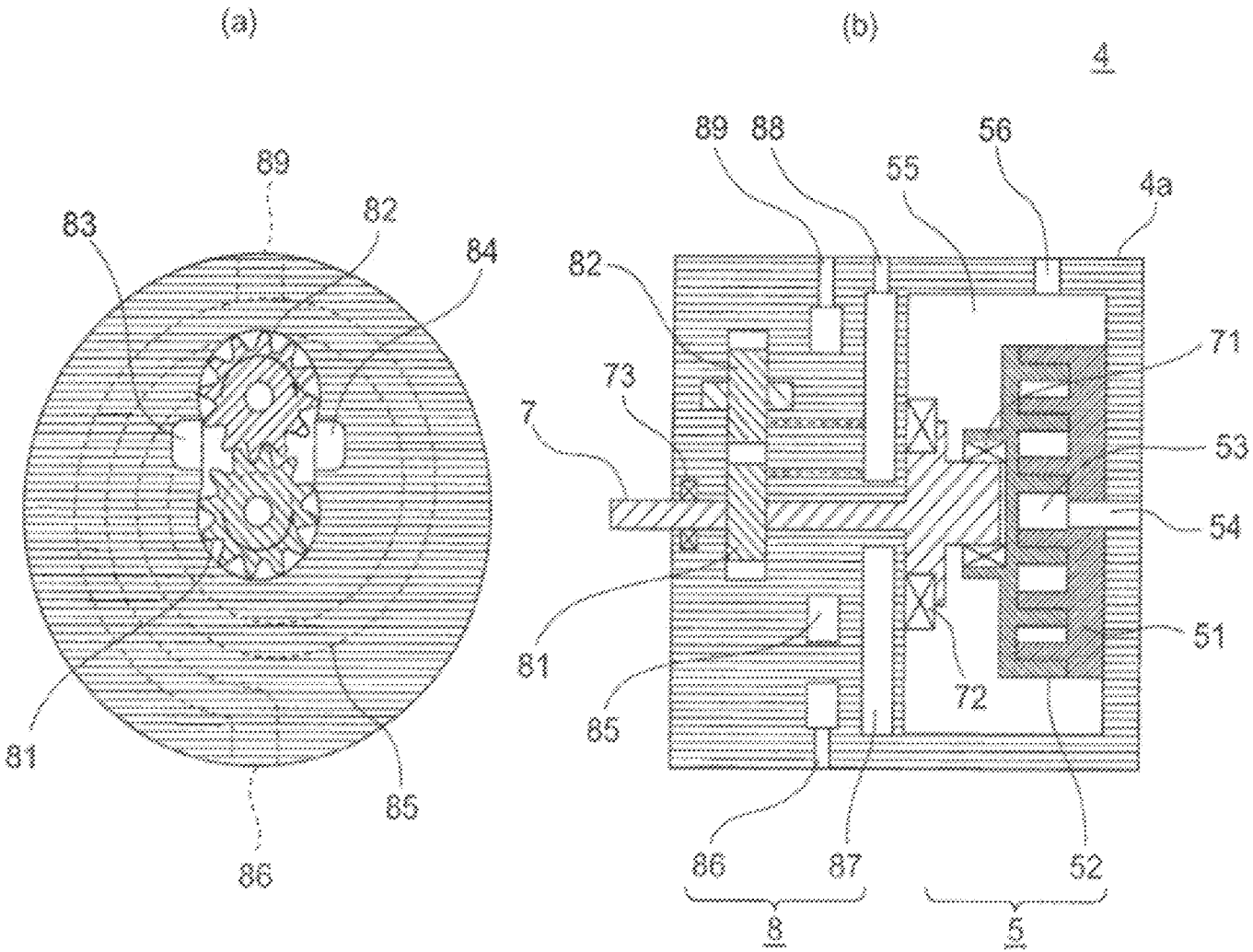
FIG. 14 Views illustrating a specific configuration of a pump-integrated type expansion device of an exhaust heat regeneration system according to Embodiment 9 of the present invention.
Figure 15:
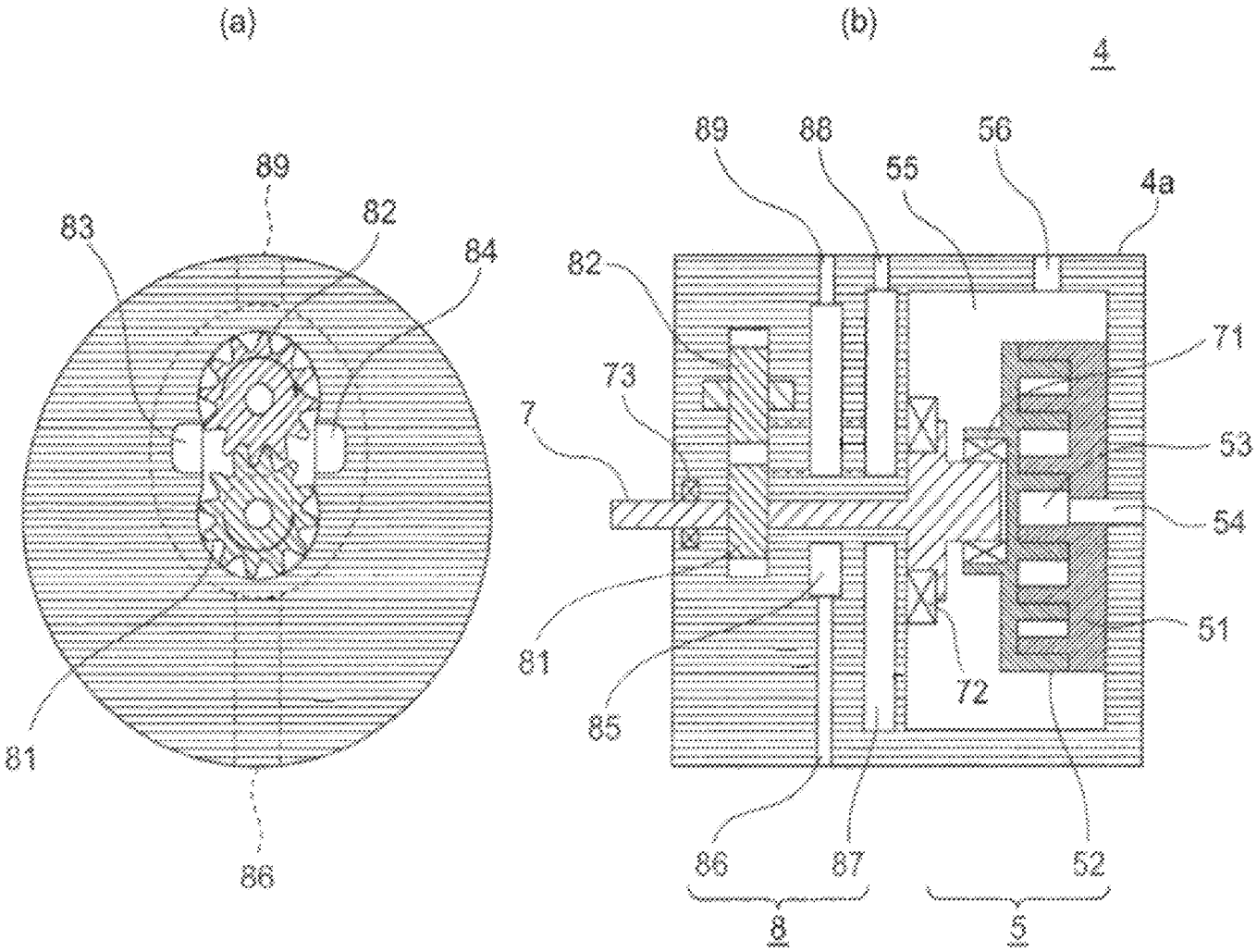
FIG. 15 Views illustrating another specific configuration of the pump-integrated type expansion device of the exhaust heat regeneration system according to Embodiment 9 of the present invention.

An exhaust heat regeneration system according to Embodiment 9 of the present invention is described referring to FIGS. 14 and 15. FIG. 14 are views illustrating a specific configuration of a pump-integrated type expansion device of the exhaust heat regeneration system according to Embodiment 9 of the present invention. FIG. 15 are views illustrating another specific configuration of the pump-integrated type expansion device of the exhaust heat regeneration system according to Embodiment 9 of the present invention.

FIGS. 14(*a*) and 15(*a*) are transverse sectional views, whereas FIGS. 14(*b*) and 15(*b*) are longitudinal sectional views. FIGS. 14(*a*) and 15(*a*) are transverse sectional views of the pump when the high-pressure chamber side is viewed from the gear section, of the longitudinal cross sections of the pump-integrated type expansion devices respectively illustrated in FIGS. 14(*b*) and 15(*b*), from which the illustration of the high-pressure chamber and the outlet thereof is omitted.

In each of the embodiments described above, the case where each of the low-pressure chamber 85 and the high-pressure chamber 87 of the pump is configured by an annular channel is described. However, the low-pressure chamber 85 may be configured by a spiral channel as illustrated in FIG. 14, and the low-pressure chamber 85 may be configured by an oval channel which is provided only in the vicinity of the gears of the pump 8 as illustrated in FIG. 15.

In each of the embodiments described above, the case where the gear-type pump is used as the pump 8 is described. However, a vane-type pump or a trochoid-type pump, which are positive-displacement pumps corresponding to the same type as the gear-type pump, may be used. The same effects are provided in this case.

REFERENCE SIGNS LIST

1 engine, 2*a* cooling-water circuit, 2*b* cooling-water circuit, 3 evaporator, 4 pump-integrated expansion device, 4*a* casing, 5 expansion device, 6 condenser, 7 shaft, 8 pump, 9 motor-generator, 11 on-off valve, 12 second pump, 13 three-way valve, 21 first pipe, 22 second pipe, 23 third pipe, 24 fourth pipe, 25 fifth pipe, 26 sixth pipe, 27 seventh pipe, 31 temperature sensor, 32 pressure sensor, 33 flow-rate sensor, 34 frequency sensor, 41 first pulley, 42 engine output shaft, 43 second pulley, 44 belt, 51 fixed scroll, 52 swing scroll, 53 expansion chamber, 54 inlet port, 55 low-pressure space, 56 outlet, 81 first gear, 82 second gear, 83 inlet port, 84 discharge port, 85 low-pressure chamber, 86 inlet port, 87 high-pressure chamber, 88 outlet, 89 outlet, 100 Rankine cycle.

The invention claimed is:

1. An exhaust heat regeneration system, comprising:

an evaporator to cool engine cooling water by heat exchange with a refrigerant;

an expansion device to expand the refrigerant heated through the evaporator so as to generate a driving force;

a condenser to cool the refrigerant that has passed through the expansion device to condense the refrigerant; and a pump to pressure-feed the refrigerant cooled through the condenser to the evaporator, wherein:

the expansion device is coupled to the pump by a shaft, and the expansion device and the pump are housed within a same casing to constitute a pump-integrated expansion device; and the pump comprises a high-pressure chamber through which the refrigerant to be discharged to the evaporator flows, the high-pressure chamber being limited to an expansion device side of the casing, which is a side of the casing in an axial direction of the shaft that includes the expansion device, and limited to a space between moving parts of the pump and the expansion device in the axial direction.

2. The exhaust heat regeneration system according to claim 1, wherein the pump is a gear pump that further comprises a gear section provided on a side of the casing that is opposite to the expansion device side of the casing in the axial direction with the high-pressure chamber limited to a space between the gear section and the expansion device in the axial direction, to boost the refrigerant.

3. An exhaust heat regeneration system, comprising:

an evaporator to cool engine cooling water by heat exchange with a refrigerant;

an expansion device to expand the refrigerant heated through the evaporator so as to generate a driving force;

a condenser to cool the refrigerant that has passed through the expansion device to condense the refrigerant; and a pump to pressure-feed the refrigerant cooled through the condenser to the evaporator, wherein:

the expansion device is coupled to the pump by a shaft, and the expansion device and the pump are housed within the same casing to constitute a pump-integrated expansion device;

the pump comprises a low-pressure chamber through which the refrigerant flowing from the condenser flows, the low-pressure chamber limited to an expansion device side of the casing, which is a side of the casing in an axial direction of the shaft that includes the expansion device, wherein the pump is a gear pump that further comprises a gear section provided on a side of the casing that is opposite to the expansion device side of the casing in the axial direction with the low-pressure chamber limited to a space between the gear section and the expansion device in the axial direction, to boost the refrigerant.

4. An exhaust heat regeneration system, comprising:

an evaporator to cool engine cooling water by heat exchange with a refrigerant;

an expansion device to expand the refrigerant heated through the evaporator so as to generate a driving force;

a condenser to cool the refrigerant that has passed through the expansion device to condense the refrigerant; and a pump to pressure-feed the refrigerant cooled through the condenser to the evaporator, wherein:

the expansion device is coupled to the pump by a shaft, and the expansion device and the pump are housed within a same casing to constitute a pump-integrated expansion device; and the pump comprises:

a high-pressure chamber through which the refrigerant to be discharged to the evaporator flows, the high-pressure chamber limited to an expansion device side of the casing, which is a side of the casing in an axial direction of the shaft that includes the expansion device, and limited to a first space between moving parts of the pump and the expansion device in the axial direction; and a low-pressure chamber through which the refrigerant flowing from the condenser flows, the low-pressure chamber limited to a side of the casing that is opposite to the expansion device side in the axial direction with the high-pressure chamber and the first space provided between the low pressure chamber and the expansion device in the axial direction, and the low-pressure chamber limited to a second space that is past the first space in the axial direction away from the expansion device.

5. The exhaust heat regeneration system according to claim 4, wherein the pump is a gear pump that further comprises a gear section provided on a side of the casing, in the axial direction, that is opposite to a side of the casing that includes the high-pressure chamber with the low-pressure chamber provided between the gear section and the high-pressure chamber, to boost the refrigerant, such that the second space is between the gear section and the first space.

6. The exhaust heat regeneration system according to claim 4, wherein the pump is a gear pump that further comprises a gear section provided between the high-pressure chamber and the low-pressure chamber in the axial direction, to boost the refrigerant, such that the first space, the gear section, and the second space are arranged in this order in the axial direction away from the expansion device.

7. The exhaust heat regeneration system according to claim 4, wherein:

the pump is provided in a vicinity of a lowermost part relative to the condenser;

the exhaust heat regeneration system further comprises:

a first pipe for allowing the refrigerant to flow from the low-pressure chamber of the pump to the condenser;

a second pipe for allowing the refrigerant to flow from the condenser to the low-pressure chamber of the pump; and an on-off valve provided in a middle of the first pipe; and when an engine stops, the on-off valve is opened so that the refrigerant is capable of circulating from the low-pressure chamber through the first pipe to the condenser and then from the condenser through the second pipe to the low-pressure chamber.

8. The exhaust heat regeneration system according to claim 5, wherein:

the pump is provided in a vicinity of a lowermost part relative to the condenser;

the exhaust heat regeneration system further comprises:

a first pipe for allowing the refrigerant to flow from the low-pressure chamber of the pump to the condenser;

a second pipe for allowing the refrigerant to flow from the condenser to the low-pressure chamber of the pump; and an on-off valve provided in a middle of the first pipe; and when an engine stops, the on-off valve is opened so that the refrigerant is capable of circulating from the low-pressure chamber through the first pipe to the condenser and then from the condenser through the second pipe to the low-pressure chamber.

9. The exhaust heat regeneration system according to claim 6, wherein:

the pump is provided in a vicinity of a lowermost part relative to the condenser;

the exhaust heat regeneration system further comprises:

a first pipe for allowing the refrigerant to flow from the low-pressure chamber of the pump to the condenser;

a second pipe for allowing the refrigerant to flow from the condenser to the low-pressure chamber of the pump; and an on-off valve provided in a middle of the first pipe; and when an engine stops, the on-off valve is opened so that the refrigerant is capable of circulating from the low-pressure chamber through the first pipe to the condenser and then from the condenser through the second pipe to the low-pressure chamber.

10. The exhaust heat regeneration system according to claim 4, further comprising:

a first pipe for allowing the refrigerant to flow from the low-pressure chamber of the pump to the condenser;

a second pipe for allowing the refrigerant to flow from the condenser to the low-pressure chamber of the pump; and a second pump provided in a middle of the first pipe, wherein, when a temperature of the pump becomes higher than a predetermined temperature, the second pump is operated so that the refrigerant is capable of circulating from the low-pressure chamber through the first pipe to the condenser and then from the condenser through the second pipe to the low-pressure chamber.

11. The exhaust heat regeneration system according to claim 5, further comprising:

a first pipe for allowing the refrigerant to flow from the low-pressure chamber of the pump to the condenser;

a second pipe for allowing the refrigerant to flow from the condenser to the low-pressure chamber of the pump; and a second pump provided in a middle of the first pipe, wherein, when a temperature of the pump becomes higher than a predetermined temperature, the second pump is operated so that the refrigerant is capable of circulating from the low-pressure chamber through the first pipe to the condenser and then from the condenser through the second pipe to the low-pressure chamber.

12. The exhaust heat regeneration system according to claim 6, further comprising:

a first pipe for allowing the refrigerant to flow from the low-pressure chamber of the pump to the condenser;

a second pipe for allowing the refrigerant to flow from the condenser to the low-pressure chamber of the pump; and a second pump provided in a middle of the first pipe, wherein, when a temperature of the pump becomes higher than a predetermined temperature, the second pump is operated so that the refrigerant is capable of circulating from the low-pressure chamber through the first pipe to the condenser and then from the condenser through the second pipe to the low-pressure chamber.

13. The exhaust heat regeneration system according to claim 4, further comprising a three-way valve capable of performing switching control, for allowing the refrigerant delivered from the high-pressure chamber of the pump to flow to any one of the evaporator and the condenser, wherein, when a temperature of the pump becomes higher than a predetermined temperature, the three-way valve is switched so that the refrigerant delivered from the high-pressure chamber of the pump is allowed to flow only into the condenser.

14. The exhaust heat regeneration system according to claim 5, further comprising a three-way valve capable of performing switching control, for allowing the refrigerant delivered from the high-pressure chamber of the pump to flow to any one of the evaporator and the condenser, wherein, when a temperature of the pump becomes higher than a predetermined temperature, the three-way valve is switched so that the refrigerant delivered from the high-pressure chamber of the pump is allowed to flow only into the condenser.

15. The exhaust heat regeneration system according to claim 6, further comprising a three-way valve capable of performing switching control, for allowing the refrigerant delivered from the high-pressure chamber of the pump to flow to any one of the evaporator and the condenser, wherein, when a temperature of the pump becomes higher than a predetermined temperature, the three-way valve is switched so that the refrigerant delivered from the high-pressure chamber of the pump is allowed to flow only into the condenser.

* * * * *